US010844691B2

(12) United States Patent
Van Petegem et al.

(10) Patent No.: US 10,844,691 B2
(45) Date of Patent: Nov. 24, 2020

(54) INFLOW CONTROL DEVICE FOR WELLBORE OPERATIONS

(71) Applicant: Packers Plus Energy Services Inc., Calgary (CA)

(72) Inventors: Ronald Van Petegem, Montgomery, TX (US); John Lee Emerson, Katy, TX (US)

( * ) Notice: Subject to any disclaimer, the term of this patent is extended or adjusted under 35 U.S.C. 154(b) by 0 days.

(21) Appl. No.: 16/281,073

(22) Filed: Feb. 20, 2019

(65) Prior Publication Data

US 2019/0186235 A1 Jun. 20, 2019

Related U.S. Application Data

(63) Continuation of application No. 15/235,970, filed on Aug. 12, 2016, now Pat. No. 10,214,991.

(60) Provisional application No. 62/281,340, filed on Jan. 21, 2016, provisional application No. 62/204,611, filed on Aug. 13, 2015.

(51) Int. Cl.
*E21B 34/08* (2006.01)
*E21B 43/12* (2006.01)

(52) U.S. Cl.
CPC ..... *E21B 34/08* (2013.01); *E21B 43/12* (2013.01)

(58) Field of Classification Search
CPC ..... E21B 34/08; E21B 43/12
USPC ..... 166/320
See application file for complete search history.

(56) References Cited

U.S. PATENT DOCUMENTS

2011/0017311 A1* 1/2011 Mathiesen ..... E21B 34/08 137/14
2014/0216733 A1* 8/2014 Mathiesen ..... E21B 34/08 166/252.5
2015/0376980 A1* 12/2015 Huffer ..... E21B 43/14 166/378

* cited by examiner

*Primary Examiner* — Taras P Bemko
(74) *Attorney, Agent, or Firm* — Prince Lobel Tye LLP

(57) ABSTRACT

An adjustable and fixed inflow control device is provided. According to one embodiment, the adjustable inflow control device comprises a set of flow path walls defining a flow path that extends from an inlet to an outlet. The inlet may be open to the outer surface of a tubular and the outlet may be fluidly connected to an inner diameter of the tubular. The flow path may be adapted to control flow of fluid between the outlet and the inlet. The inflow control device further comprises a movable regulator that is movable to alter the flow path. The movable regulator may be movable between a number of positions. The inflow control device may be modular.

19 Claims, 28 Drawing Sheets

INFLOW CONTROL DEVICE FOR WELLBORE OPERATIONS

CROSS-REFERENCE TO RELATED APPLICATION(S)

This application claims a benefit of priority from U.S. Provisional Application No. 62/281,340, filed Jan. 21, 2016, entitled "INFLOW CONTROL DEVICE FOR WELLBORE OPERATIONS," and U.S. Provisional Application No. 62/204,611, filed Aug. 13, 2015, entitled "INFLOW CONTROL DEVICE FOR WELLBORE OPERATIONS," and U.S. Non-Provisional application Ser. No. 15/235,970, filed Aug. 12, 2016, entitled "INFLOW CONTROL DEVICE WELLBORE OPERATIONS", the entire disclosures of which are hereby incorporated by reference herein.

TECHNICAL FIELD

The present invention relates to wellbore methods and apparatuses. More particularly, this disclosure relates to flow control devices for wellbores. Even more particularly, this disclosure relates to modular inflow control devices to control the flow of fluids into a wellbore and may provide varying levels of restriction based on conditions (e.g., pressure differential, flow velocity) or fluid properties (e.g., viscosity, phase, density).

BACKGROUND OF THE RELATED ART

When a producing horizontal wellbore formation is flowing oil, gas or water either as a single phase or any combination of phases, the flow can occur in unpredictable or suboptimal manners. For example, the rate of fluid inflow at the heel could be significantly higher than the rate at the toe. This may cause an effect know to the industry as "coning". Coning can cause many issues including but not limited to: reduction of hydrocarbon flow, excessive water flow, excessive gas flow or excessive annular flow. Additionally, over time, the relative quantity of each phase (water, gas, crude oil) may change and one or more phases may dominate the flow. Besides the above described inflow rate variations between the heel and the toe of a well; other inflow variations between other well bore sections may exist and may also require inflow regulation.

Inflow Control Devices (ICDs) can be used to limit flow between the formation and the down hole device in which it is installed. The ICD is generally intended to regulate the flow between the formation and the production tubulars and thus may be used to mitigate coning and other inflow effects such as but not limited to gas or water breakthrough.

Prior art ICDs can be divided in two main categories:

1. Choke-type (Bernoulli principle)
2. Tortuous and helical flow path
3. Fluidics Generally, conventional choke-type ICDs employ a circular port to create a drop in pressure. The flow path is conventionally formed in a helix about the center axis of the ICD. Choke or Nozzle type devices are normally governed by Bernoulli's principle. Although there can be some impact, the effect on pressure drop caused by variations in fluid viscosity for nozzle or choke based inflow devices is typically negligible. Conventional tortuous flow path ICDs employ a flow path formed by constraining walls in which the flow path has numerous corners along the flow axis which cause numerous directional changes in the fluid passing therethrough. Helical flow paths, guide the fluids around a circular path. Both helical and tortuous flow paths are typically governed by Darcy-Weisbach and other principles and can be sensitive to changes in fluid viscosity. Fluidic or fluid amplification devices typically take one fluid stream and jet it into another, normally from the side or other angle, causing a change in amplification or velocity or even flow direction. The flow paths in conventional ICDs are typically fixed and contain no moving parts Moreover, conventional ICD's available do not autonomously reduce water flow within in low (e.g., <10 cP) viscosity crude.

SUMMARY OF THE DISCLOSURE

According to one aspect of the present disclosure, an adjustable inflow control device is provided. According to one embodiment, the adjustable inflow control device comprises a set of flow path walls defining a flow path that extends from an inlet to an outlet. The inlet may be open to the outer surface of a tubular and the outlet may be fluidly connected to an inner diameter of the tubular. The flow path may be adapted to control flow of fluid between the outlet and the inlet. The inflow control device can further comprise a movable regulator that is movable to alter the flow path such that the inflow control device can provide multiple flow control configurations for controlling inflow. The movable regulator may be movable between a number of positions, including but not limited to a tortuous flow position, a choke flow position and a fluidics flow position. In one embodiment, the regulator may be adjusted to a selected position and then locked in position for operation. In another embodiment, the regulator is autonomously movable responsive to downhole conditions to alter the flow path.

In accordance with one embodiment, the set of flow path walls comprise a fixed flow path wall and a movable flow path wall. The regulator may be axially slidable to move the movable flow path wall relative to the fixed flow path wall to alter the flow path. The movable wall, in one embodiment, may be movable to create a series of choke points along the flow path.

In accordance with another embodiment, the regulator comprises a wing type structure having a cambered surface shaped to generate a hydrodynamic force normal to the cambered surface as fluid in the flow path moves across the regulator. The regulator may be movable responsive to the hydrodynamic force to change the pressure drop across the flow path. In one embodiment, for example, the regulator may rotate to change the distance between the regulator and a fixed flow path wall.

The regulator may be sensitive to fluid density such that the introduction of a different density fluid into the flow path results in an increase or decrease in the generated hydrodynamic force. In accordance with one embodiment, the regulator is sensitive to density such that the regulator is adapted to alter the cross-sectional area of the flow path if a flow crude oil through the flow path changes to a flow comprising water, gas or sand, such as a flow of water or a combination of crude oil and water. Likewise, a regulator may alter the cross-sectional area of the flow path if a flow of gas through the flow path changes to a flow comprising water or sand.

According to another embodiment, an ICD apparatus may include a Tesla profile selected to create a desired pressure drop across the flow path. The Tesla profile may comprise a plurality of profiles in series. According to one embodiment, the Tesla profile comprises a first Tesla profile in series with a second Tesla profile, the second Tesla profile adapted to provide a different resistance to inflow than the first Tesla profile. In one embodiment, the first Tesla profile is configured to allow inflow to flow through with significantly less restriction than the second Tesla profile. The second Tesla profile may also be adapted to provide a different resistance to outflow than the first Tesla profile. For example, the second Tesla profile is configured to allow outflow to flow through with significantly less restriction than the first Tesla profile. Another embodiment comprises a wellbore apparatus having a tubular and an inflow control device. The tubular can comprise a tubular wall with a tubular inlet port extending through the tubular wall to an inner diameter. The tubular can at least partially define a pocket about the tubular inlet port. The inflow control device comprises an ICD module disposed in the pocket. The inflow control device can have an inlet exposed to an outer surface of the tubular, an outlet fluidly connected to the tubular inlet and a set of flow path walls defining a flow path between the inlet and the outlet. The flow path can be configured to control at least one of a pressure drop or a flow rate of fluid flowing from the inlet to the outlet. The inflow control device may have a fixed flow path or an adjustable flow path. In some embodiments, the inflow control device may autonomously adjust the flow path in response to downhole conditions.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

DETAILED DESCRIPTION

Figure 1A:
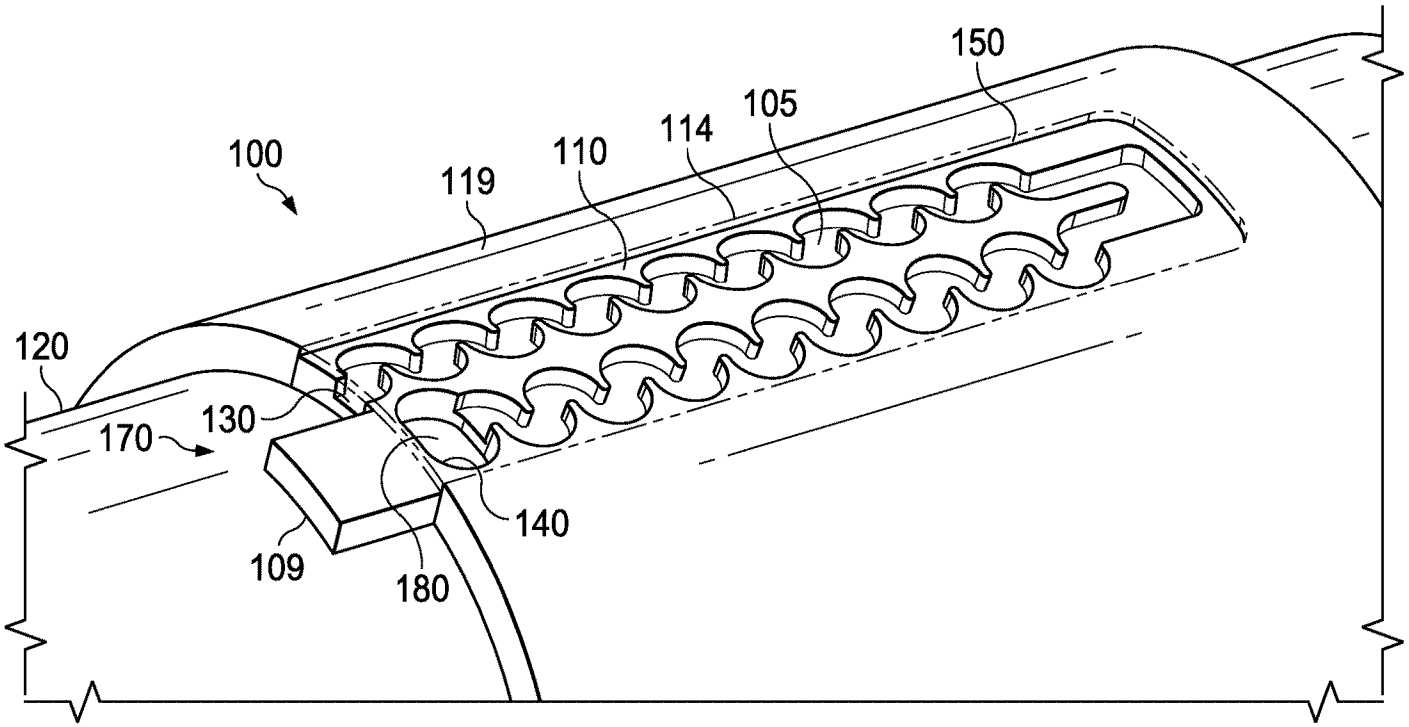
FIG. 1A depicts a diagrammatic representation of one embodiment of an inflow control device (ICD) having an ICD module with fixed flow path.

The invention and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the invention in detail. It should be understood, however, that the detailed description and the specific examples, while indicating some embodiments of the invention, are given by way of illustration only and not by way of limitation. Various substitutions, modifications, additions and/or rearrangements within the spirit and/or scope of the underlying inventive concept will become apparent to those skilled in the art from this disclosure.

As discussed above, embodiments provide inflow control devices (ICDs), including modular inflow control devices, for controlling flow of fluid. An ICD typically controls flow between the formation and wellbore. ICDs may be used for controlling the flow rate, pressure drop, or both of a fluid or a composition of fluids, flowing therethrough.

ICDs may come in various designs. ICDs may be a fixed or adjustable design. A fixed ICD may have a flow path that does not change after installation in the well. An adjustable ICD may have a flow path that can be changed. In some embodiments, an adjustable-fixed ICD may have a selectable flow path where the desired flow path is selected before insertion into the wellbore and the flow path remains fixed in the selected position during operation. In other embodiments, the flow path of the ICD may adjust during operation (i.e., when fluid is flowing through the ICD). Adjustment of the ICD may be done manually or the ICD may adjust autonomously (e.g., due to a change in fluid viscosity, fluid velocity, pressure, phase, turbulence etc.) The fixed or adjustable flow paths, in some embodiments, may be non-helical flow paths that have a generally rectangular cross-section (normal to the fluid flow direction).

ICDs may include a flow regulator mechanism to permit adjustment of the flow characteristics through the flow path of the ICD. For example, the regulator mechanism can be adjusted to provide approximately equal flow irrespective of the difference in pressure between the inlet and the outlet of the ICD. Embodiments of ICDs can be adjusted through an intervention or autonomously, in response to changing downhole flow conditions. In one embodiment, the regulator mechanism may be hydrodynamic in that the position of the regulator mechanism responds to variations in downhole conditions such as changes in one or more of fluid type, rheology, pressure drop, flow rate change, or fluid properties, including fluid flow phase or fluid density.

In accordance with one aspect, a pressure drop regulating flow path is contained within a modular device. An ICD module may have a defined form factor that can be inserted into a ICD container configured for receiving an ICD module of the defined form factor (e.g., in an ICD retaining area, such as in a pocket in a tubular or other ICD container). Using a modular design, any one of or more of various ICD modules having varying internal designs may be inserted into an ICD container as desired. Modular ICDs provide several advantages. For example, only one type of tubular may need to be kept on hand for use with any of multiple ICD designs. During installation, the desired type or configuration of ICD may be inserted immediately prior to being placed in the wellbore. Modular ICDs may also be changed out later on, for example, if well conditions or desired production changes. New ICD containers may be designed to accommodate currently available ICD modules and, conversely, new ICD modules may be developed for use with existing ICD containers. The modularity provides a significant advantage over other ICD devices by allowing the end user alter the ICD pressure drop type without having to purchase additional ICD devices or containers.

A modular design also provides the advantage that the same ICD containers can be easily used with other devices designed to fit in the ICD container. An ICD container may be fitted with a blank instead of an ICD module to close off the opening in the tubular if, for example, undesired material is flowing in through that section of the well. An ICD container may also be fitted with other devices such as but not limited to; power generating devices, pressure sensors, temperature sensors, G-force sensors or combinations thereof, filters or screens in lieu of or in combination with an ICD module or may even be left open by not fitting any device (e.g., ICD module) into the ICD retaining area. Although embodiments disclosed herein may be modular, devices may also be formed integral with an apparatus (e.g., tubular).

In operation, a plurality of ICD devices can be installed and configured along multiple points in a production string, causing the flow to be distributed. In one embodiment, ICDs may be installed along a horizontal wellbore tubing string. The plurality of ICD devices may adjust the pressure drop along a tubular or tubing string. The pressure drop provided by each of the plurality of ICD devices may be independent of the other ICD devices in the string such that, if desired, each ICD device can vary relative to the adjacent ICD devices. To accomplish a desired flow distribution, each of the ICD devices can have the same or different pressure drop regulating mechanism which can be unique for its position in the well.

The plurality of ICD devices can be selected to balance flow rate across a zone. This can provide a number of advantages including reducing or eliminating coning, reducing or preventing water or gas production from wells with high permeability contrast or fractures, preventing or reducing screen erosion due to hot-spotting, reducing or preventing annular flow and cross-flow in non-compliant completions or otherwise affect and provide desired flow from the well.

Figure 1C:
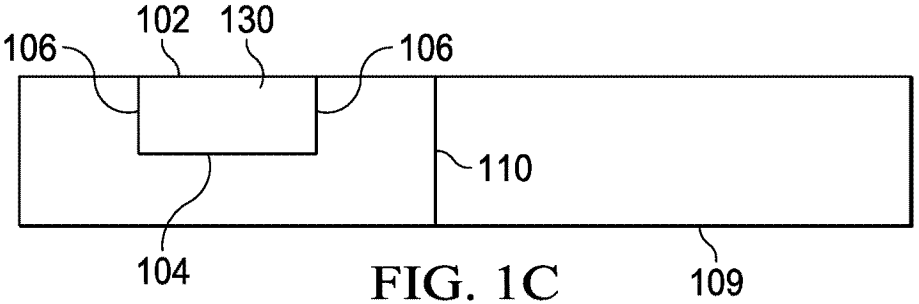
FIG. 1C depicts an end view of a fixed ICD module in accordance with one embodiment.
Figure 1B:
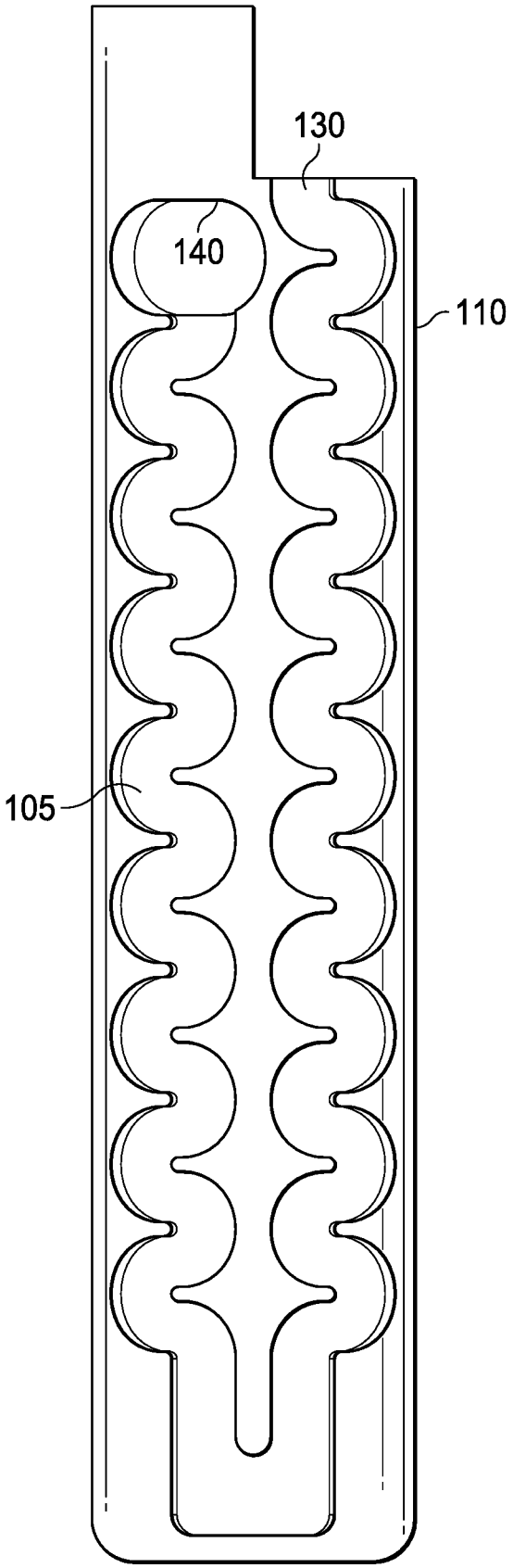
FIG. 1B depicts a top view of a fixed ICD module in accordance with one embodiment.
Figure 9A:
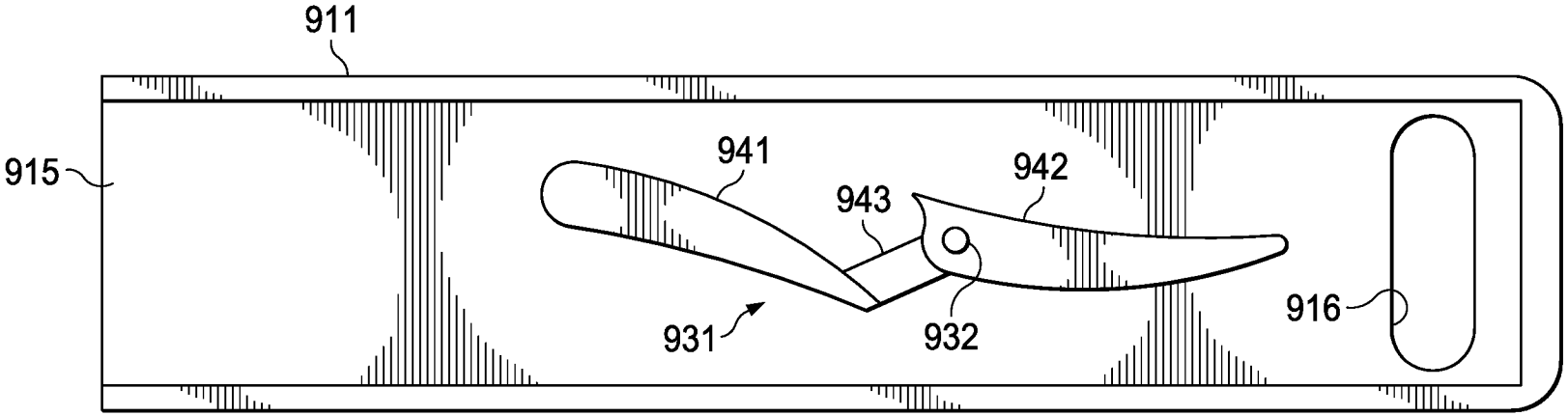
FIG. 9A depicts a diagrammatic representation of a dynamically adjustable ICD module having a hydrodynamic regulator in accordance with one embodiment.
Figure 9B:
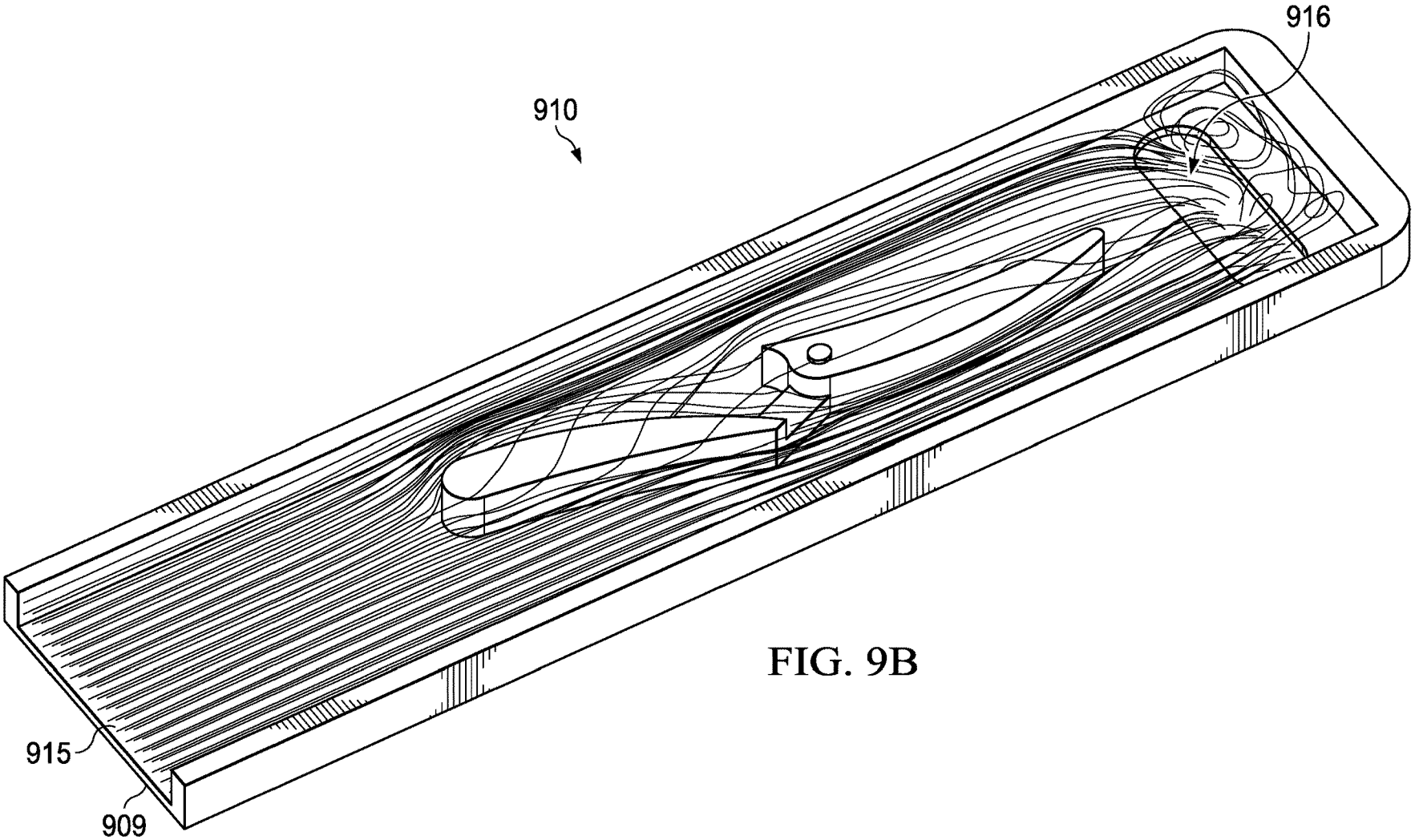
FIG. 9B depicts a simulation of fluid flow in a dynamically adjustable ICD module having a hydrodynamic regulator in accordance with one embodiment.
Figure 10:
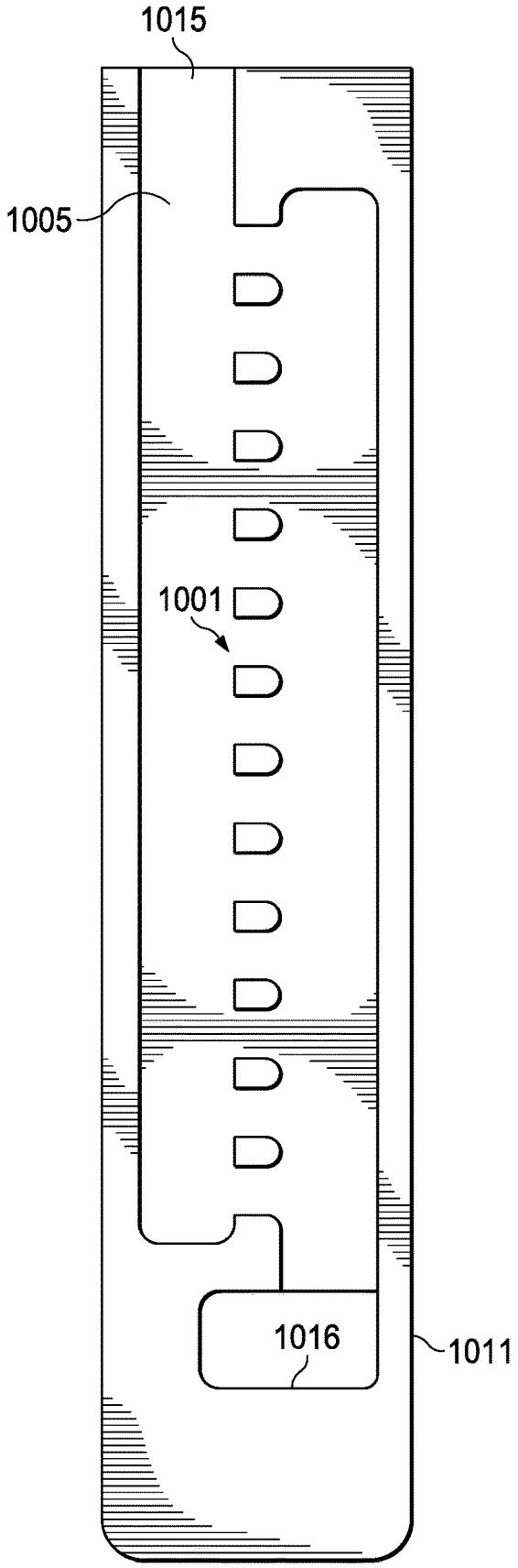
FIG. 10 depicts a top view of a fixed ICD module with parallel nozzles in accordance with one embodiment.

With reference now to FIGS. 1A-10, FIG. 1A illustrates one embodiment of a wellbore device 100 that comprises an ICD module 110 installed in an ICD container 120 and FIG. 1B illustrates ICD module 110 in more detail. FIG. 10 illustrates an end view of ICD module 110. ICD 110 can be configured to achieve desired flow control characteristics of fluid flowing through ICD 110.

In accordance with one embodiment, ICD container 120 may be a tubular having a tubular wall 119 defining an inner bore extending axially from a first end to a second end. The ends of the tubular may be threaded or otherwise be adapted for connection to other tubulars in a string. In some embodiments, ICD container 120 may be formed as a tubular that can then be mounted over another tubular.

A tubular inlet opening 180 extends through the wall 119 of the tubular so that fluid may pass from the area surrounding the tubular into the inner diameter of the tubular through the tubular wall 119. ICD container 120 includes an ICD retaining area to retain an ICD module for controlling flow entering the tubular inlet opening. In accordance with one embodiment, the ICD retaining area may be adapted to receive ICD modules or other devices having a compatible form factor. In the embodiment illustrated, the ICD retaining area is formed as a pocket 150 in wall 119 about the tubular inlet opening 180. A cover 114 (transparent for clarity) may complete pocket 150 to form a pocket interior. Pocket 150 has a pocket inlet port 170 from the outer surface 123 of device 100 to the interior of pocket 150. The tubular inlet opening 180 may serve as a pocket outlet port to allow fluid to flow from the interior of pocket 150 to the inner diameter of ICD container 120.

ICD module 110 comprises a body of one or more pieces formed as a rectangular shape having an inner wall 109, which may be curved to match the curve of the outer circumference of a tubular. The shaped flow path may extend from an ICD inlet 130 to an ICD module outlet 140. In the embodiment illustrated, ICD module 110 is adapted such that, when installed, ICD inlet 130 can be open to the fluid surrounding ICD device 100. The ICD outlet 140 may be fluidly connected to a tubular inlet opening 180 so that fluid can pass from ICD module 110 into the inner bore of ICD container 120.

ICD module 110 installed in pocket 150 provides an ICD with fixed flow path 105 between the ICD inlet 130 and an ICD outlet 140. The flow path has an upper wall 102, a lower wall 104 and two facing fixed side walls 106. In the embodiment shown in FIGS. 1A-1C, the flow path upper wall 102 is defined by the pocket cover (shown as transparent), while the lower wall 104 and two facing side walls 106 are defined by of ICD module 110. The walls 106 are positioned relative to each other to define a tortuous flow path 105 therebetween. The shape of tortuous flow path can be selected to achieve desired flow control characteristics of fluid flowing from inlet 130 to outlet 140, such as mass flow rate, pressure drop or other characteristic. While the spacing between the walls is fixed in the illustrated embodiment, the spacing may vary along the length of the flow path 105. For example, the spacing between the two facing sidewalls 106 may be larger at the inlet than at the outlet. Furthermore, while the flow path is illustrated as having a rectangular cross sectional shape, the flow path may have other geometries. ICD module 110 may be referred to as having a fixed tortuous flow path with high pressure drop.

In other embodiments, the flow path may be formed integral to the apparatus, for example, as a machined port through the tubular wall. Furthermore, in other embodiments, an ICD module may be adapted for installation on the surface of an apparatus, such a tubular, without a pocket. Moreover, one of ordinary skill in the art would recognize that the flow path can be varied as desired, for example, to add further return paths, to omit the return path, to omit the smaller turns and to replace them with alternately defined choke points, etc.

Figure 2A:
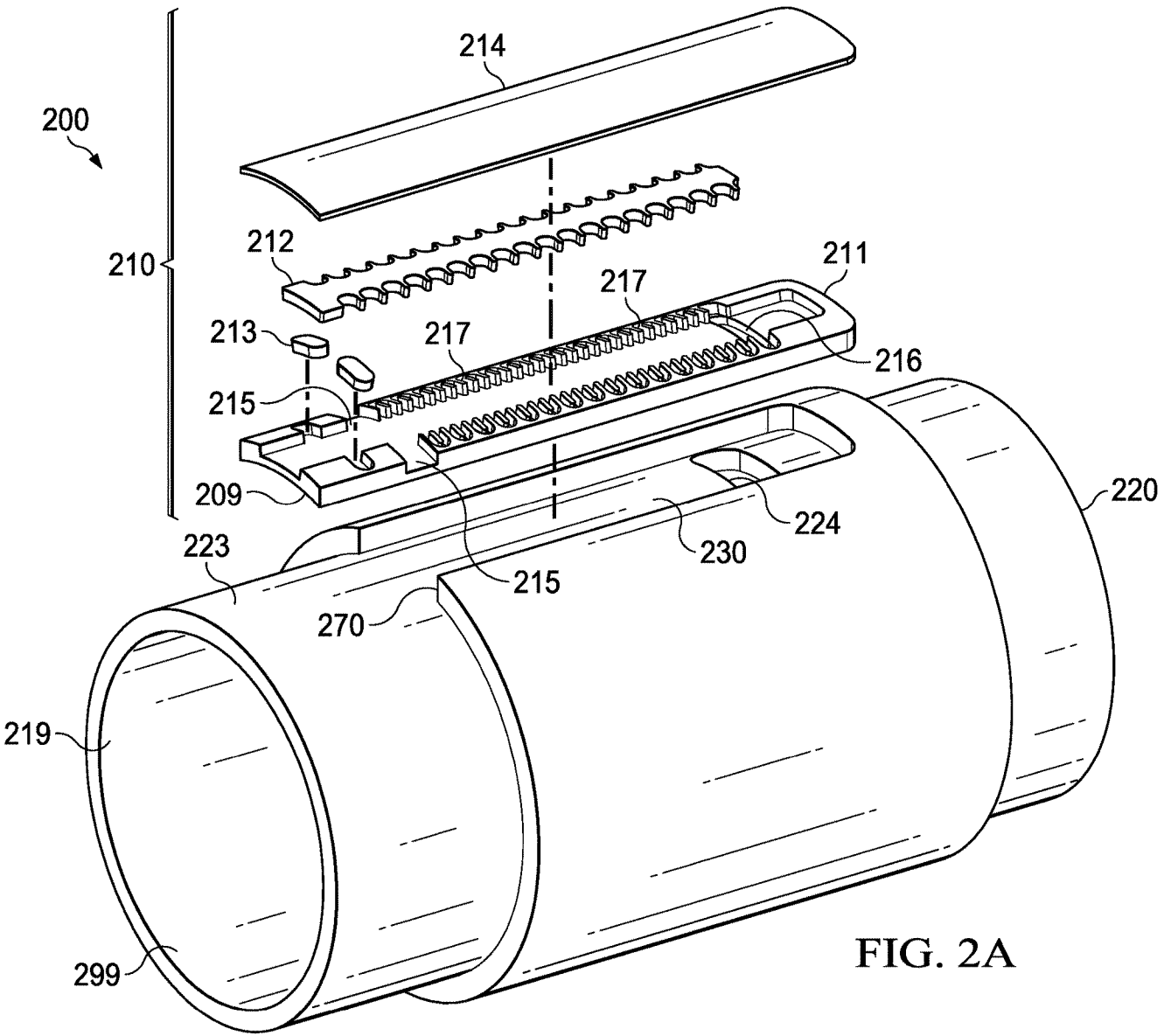
FIG. 2A depicts a diagrammatic representation of an exploded view of an adjustable ICD module and apparatus in accordance with one embodiment.
Figure 2B:
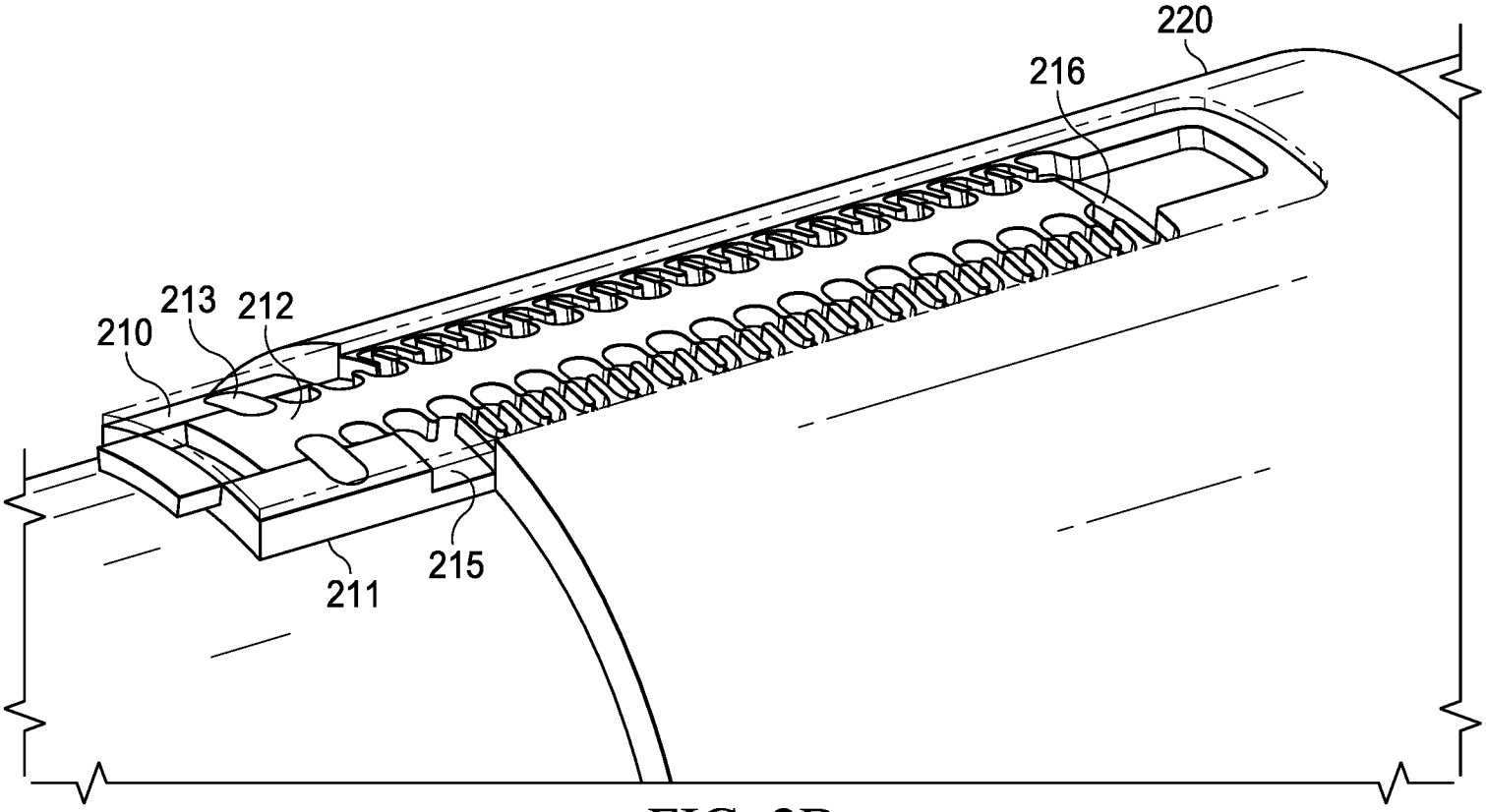
FIG. 2B depicts a diagrammatic representation of an adjustable ICD module and apparatus in accordance with one embodiment.
Figure 2C:
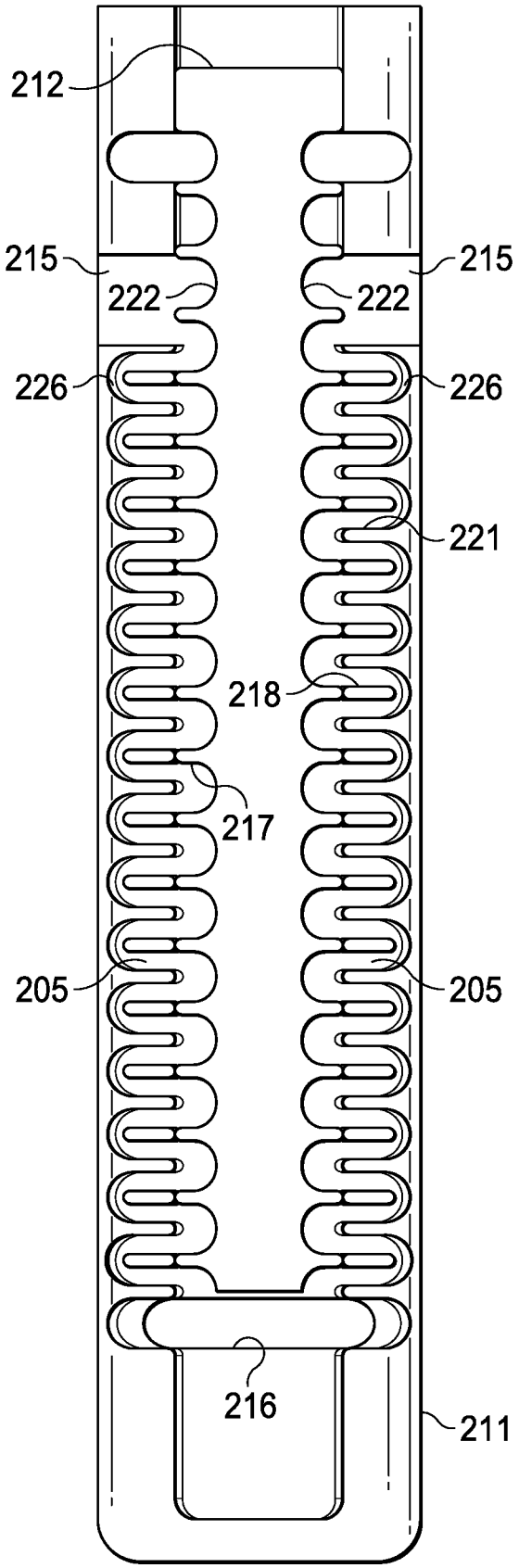
FIG. 2C depicts a top view of an adjustable ICD module in accordance with one embodiment.
Figure 2D:
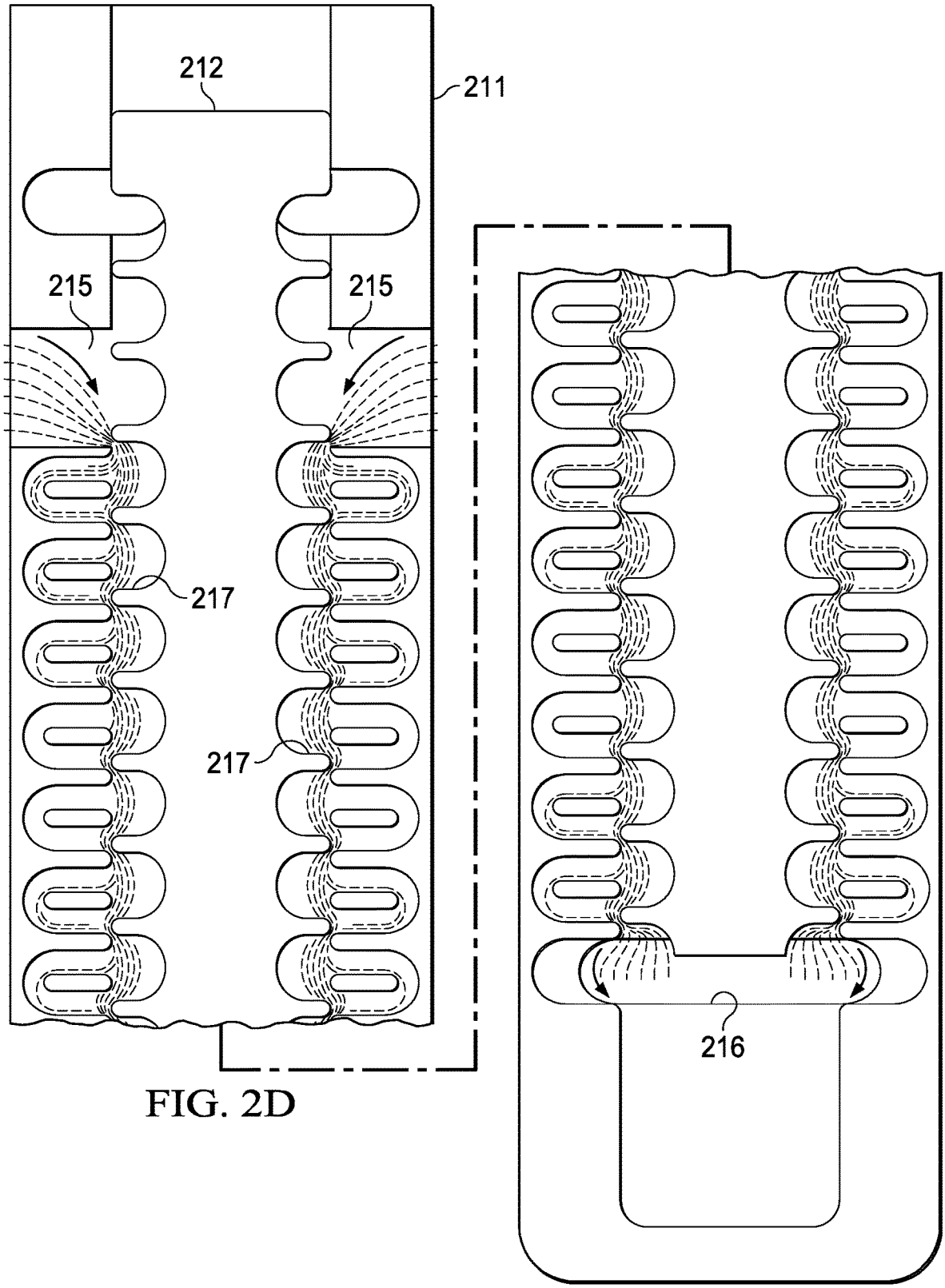
FIG. 2D depicts a diagrammatic representation of an adjustable ICD module in a choke flow position in accordance with one embodiment.
Figure 2E:
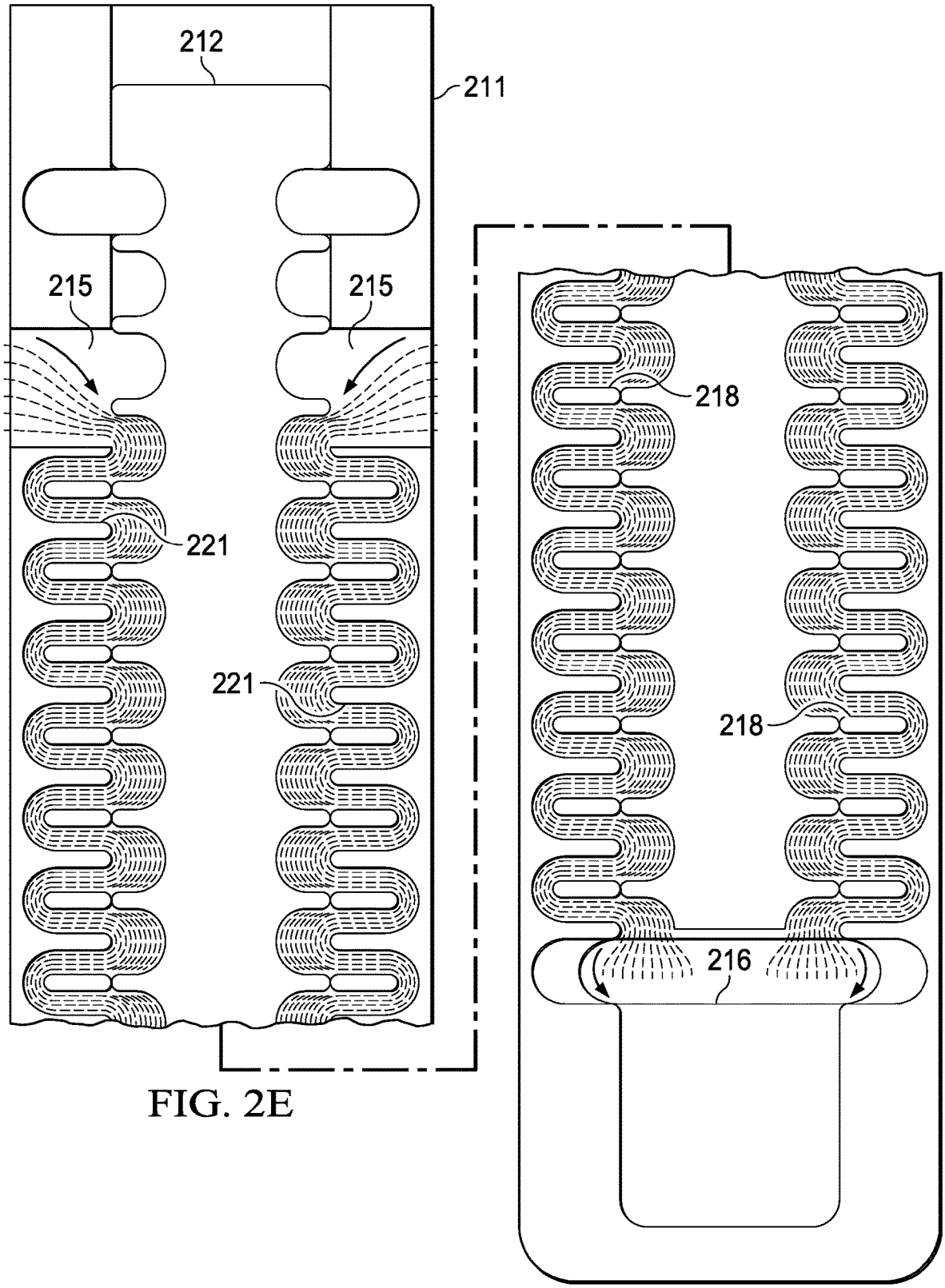
FIG. 2E depicts a diagrammatic representation of an adjustable ICD module in a tortuous flow position in accordance with one embodiment.
Figure 2F:
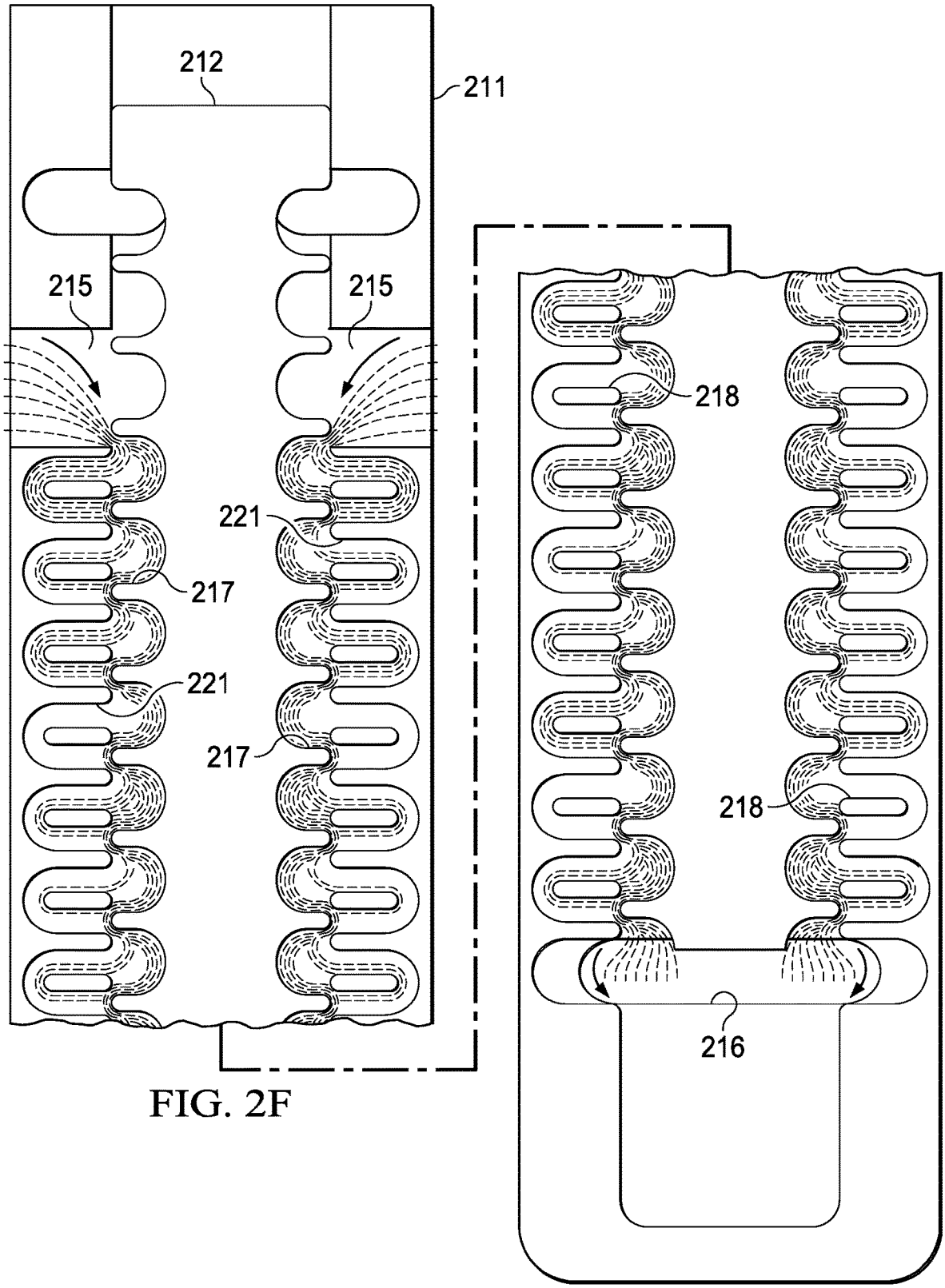
FIG. 2F depicts a diagrammatic representation of an adjustable ICD module in a fluidics flow position in accordance with one embodiment.
Figure 3A:
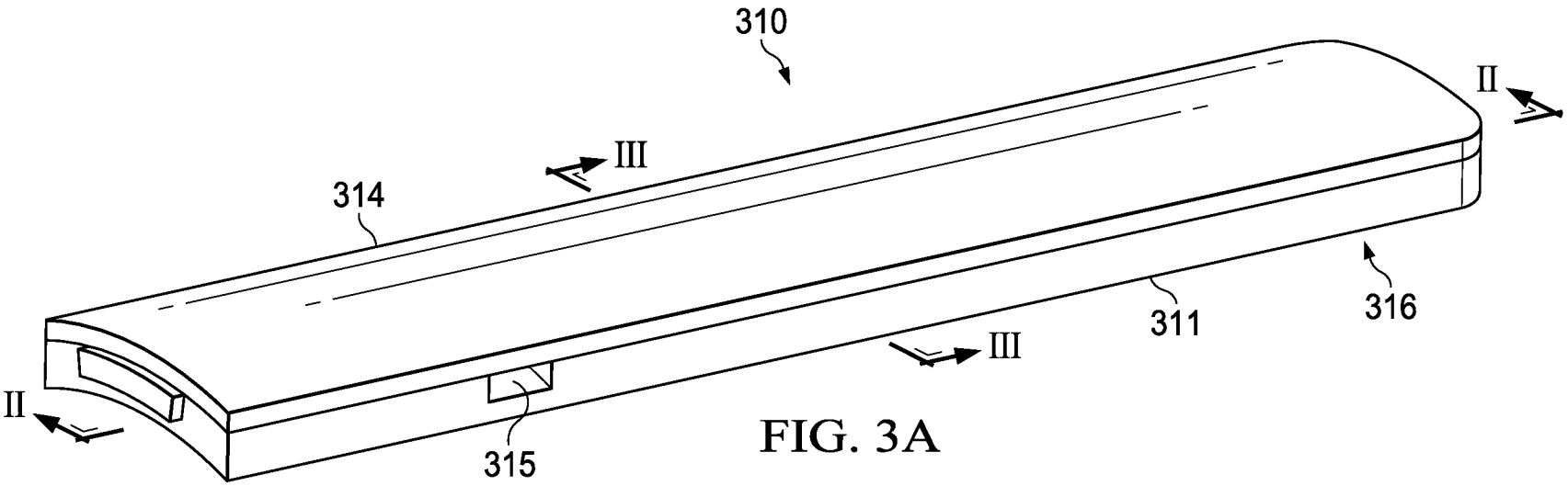
FIG. 3A depicts a diagrammatic representation of a dynamically adjustable ICD module in accordance with one embodiment.
Figure 3B:
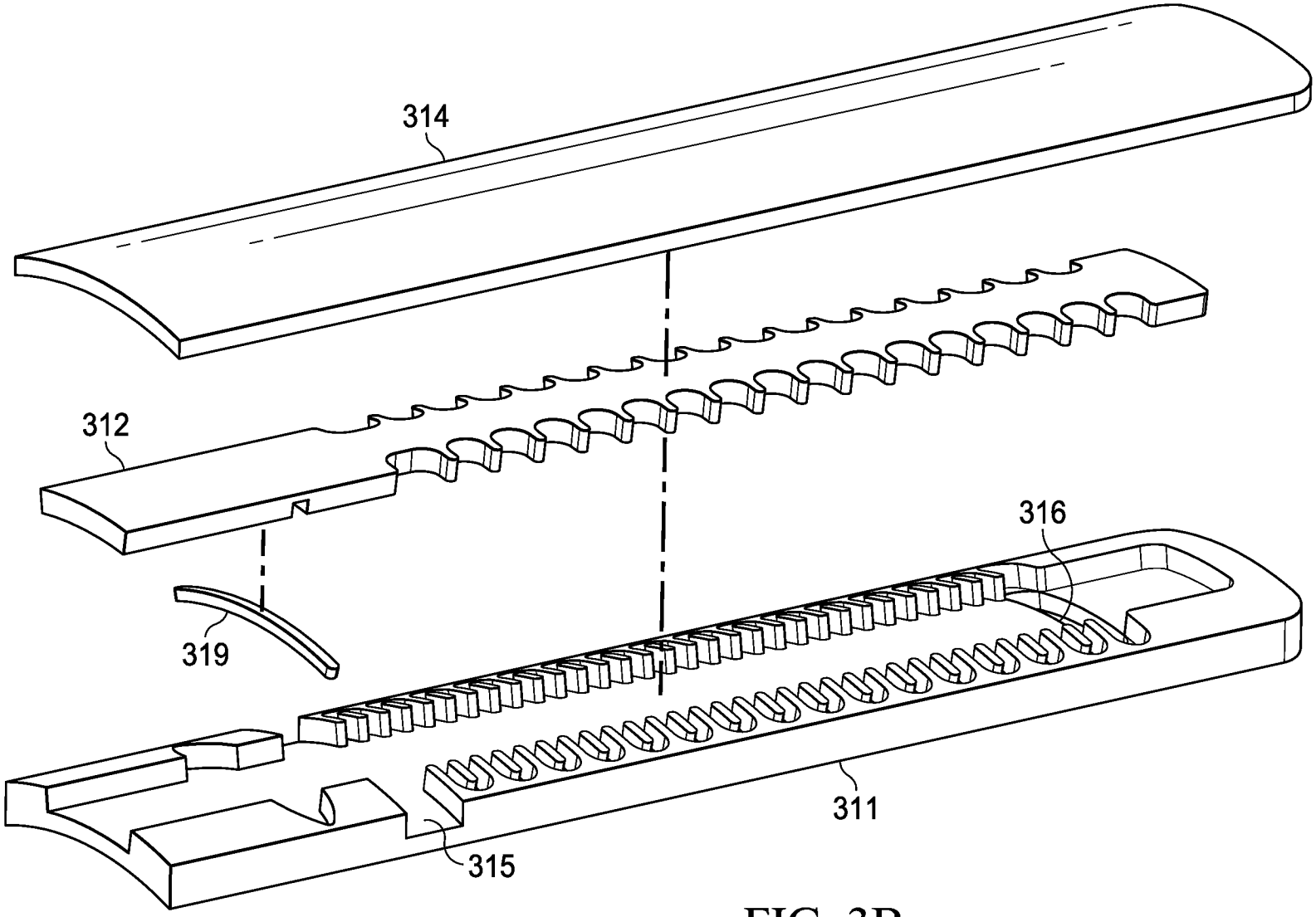
FIG. 3B depicts a diagrammatic representation of an exploded view of a dynamically adjustable ICD module in accordance with one embodiment.
Figure 3C:
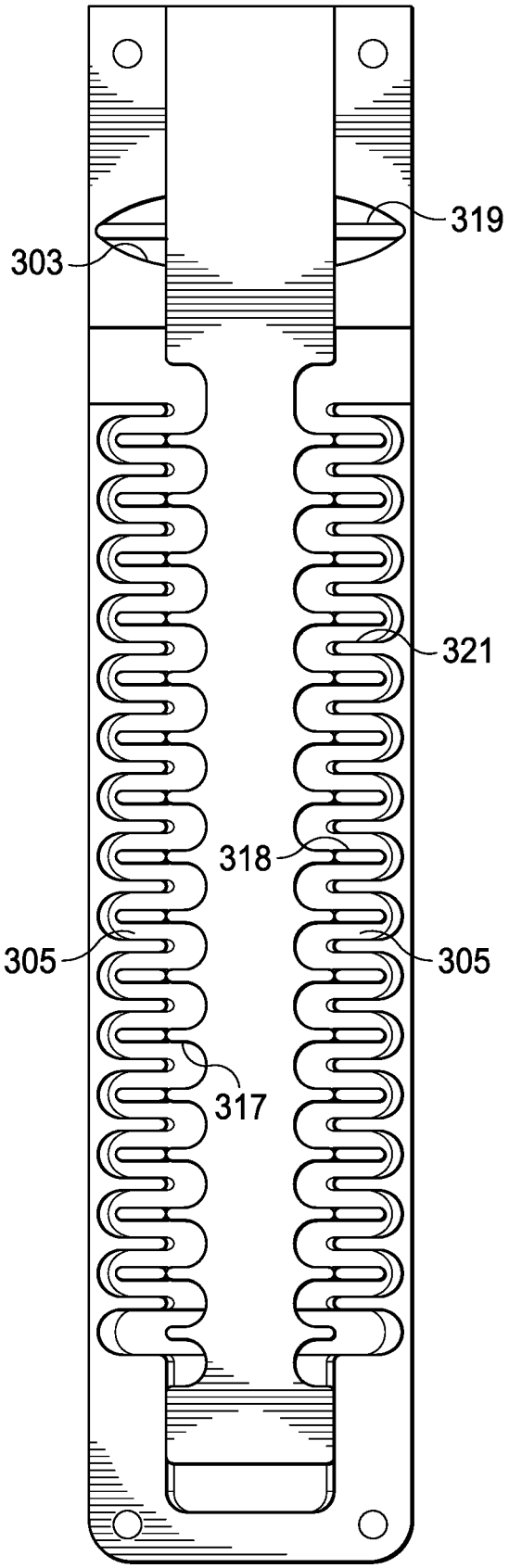
FIG. 3C depicts a top view of a dynamically adjustable ICD module in accordance with one embodiment.
Figure 3D:
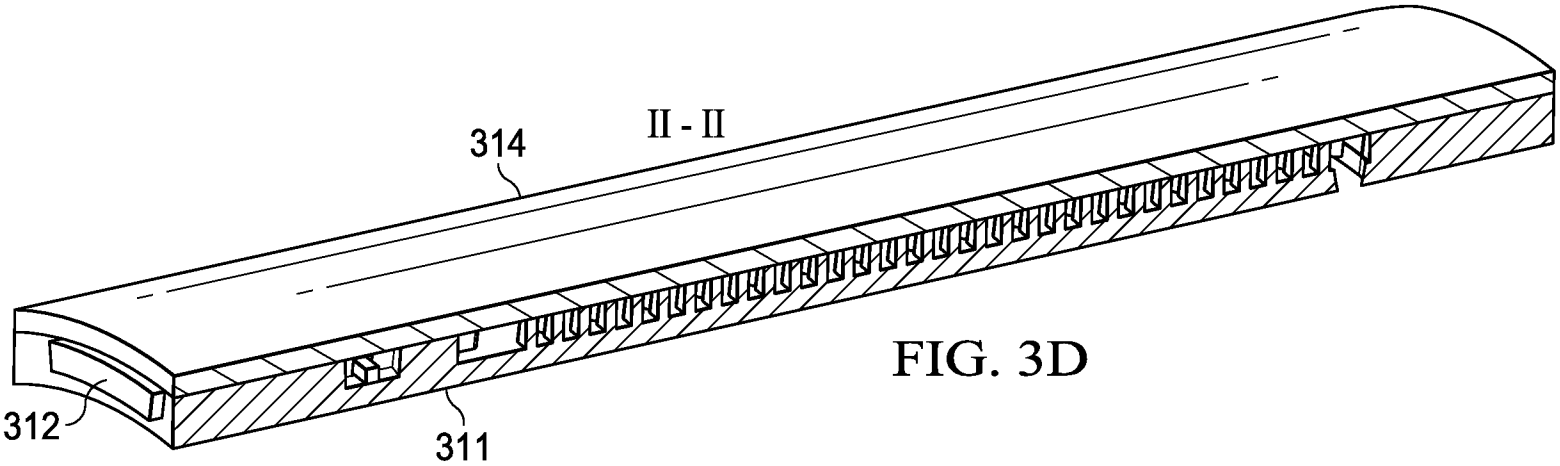
FIG. 3D depicts a longitudinal sectional view of a dynamically adjustable ICD module in accordance with one embodiment.
Figure 3E:
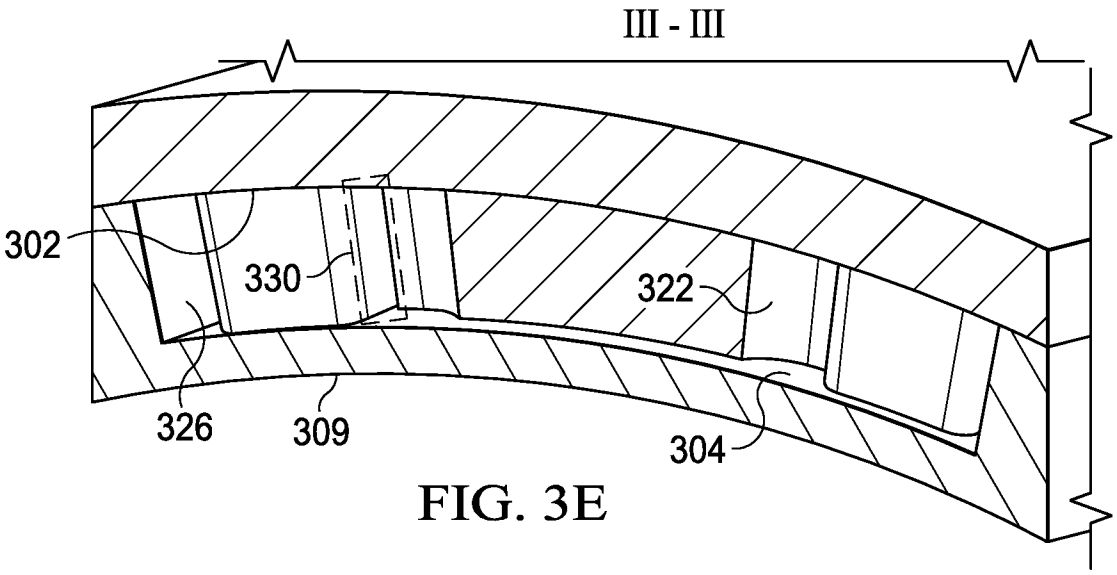
FIG. 3E depicts a transverse sectional view of a dynamically adjustable ICD module in accordance with one embodiment.
Figure 4A:
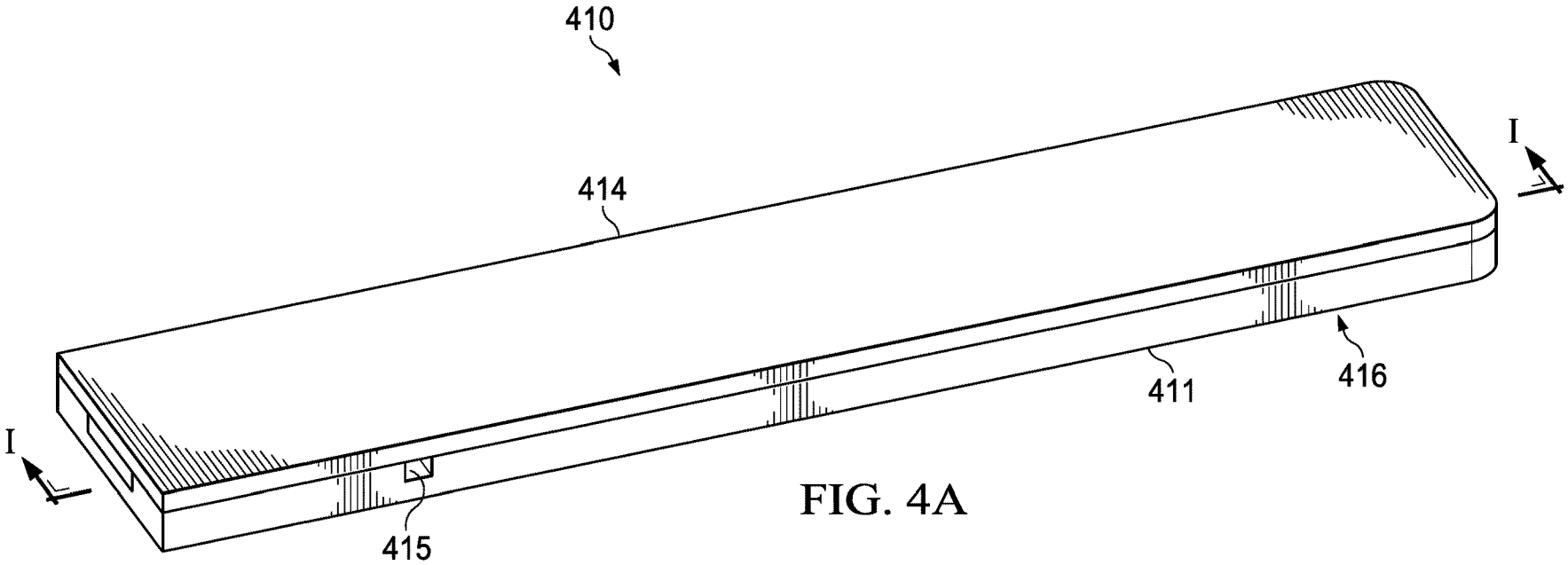
FIG. 4A depicts a diagrammatic representation of a dynamically adjustable ICD module in accordance with one embodiment.
Figure 4B:
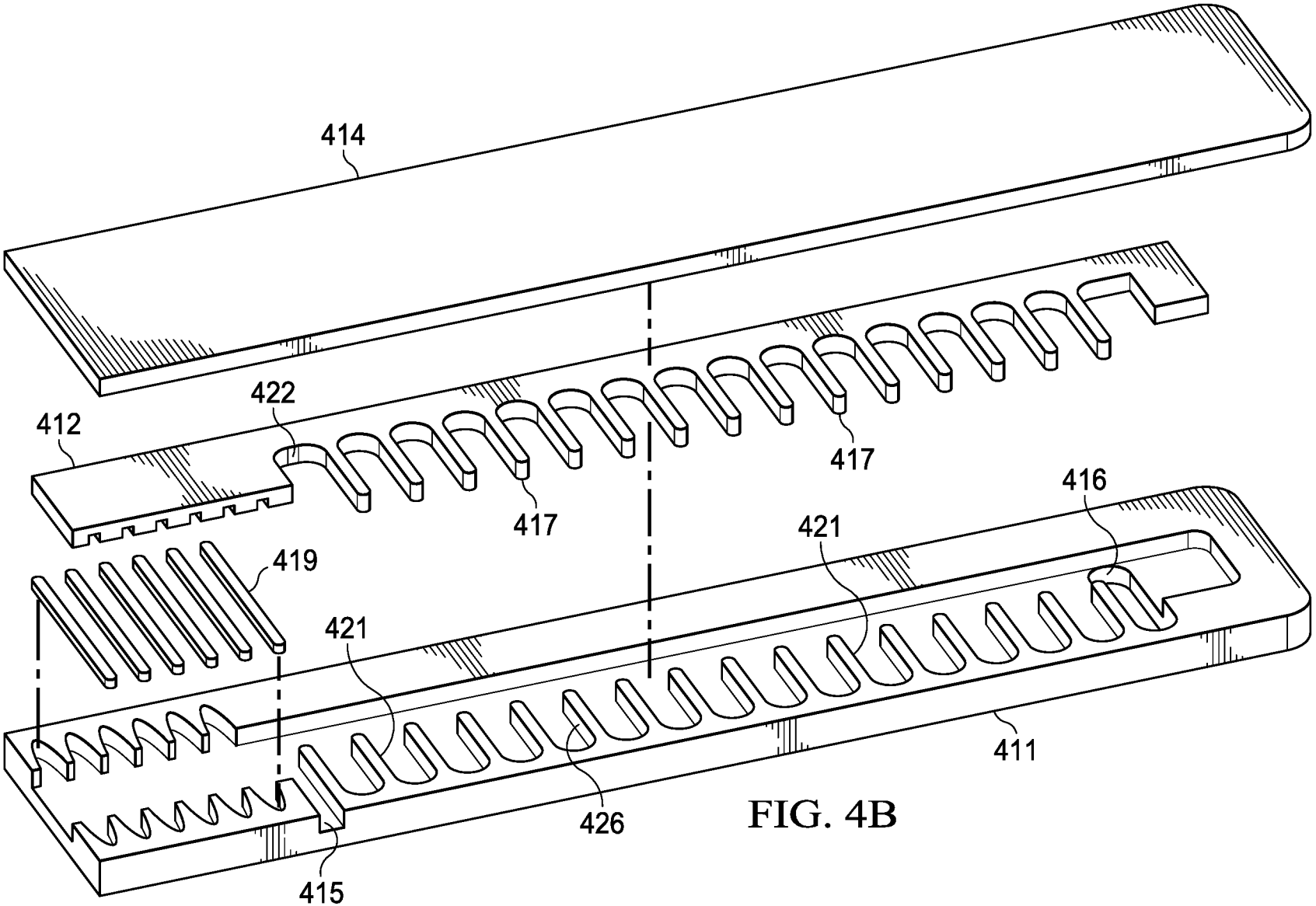
FIG. 4B depicts an exploded view of a dynamically adjustable ICD module in accordance with one embodiment.
Figure 4C:
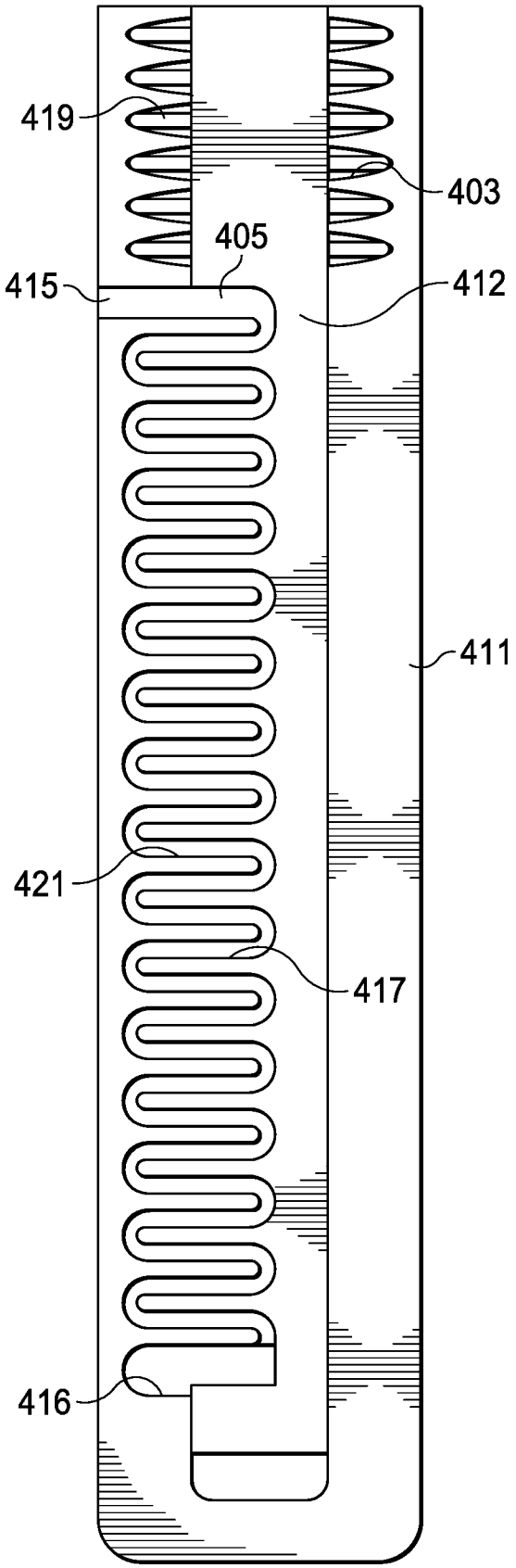
FIG. 4C depicts a top view of a dynamically adjustable ICD module in accordance with one embodiment.
Figure 4D:
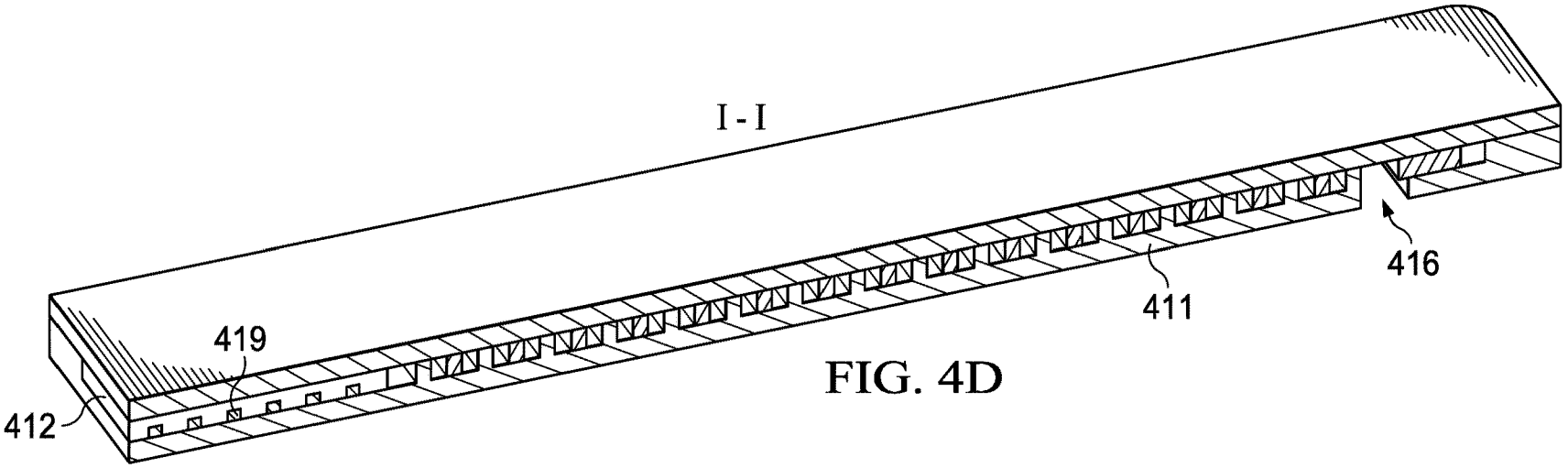
FIG. 4D depicts a longitudinal sectional view of a dynamically adjustable ICD module in accordance with one embodiment.
Figure 4E:
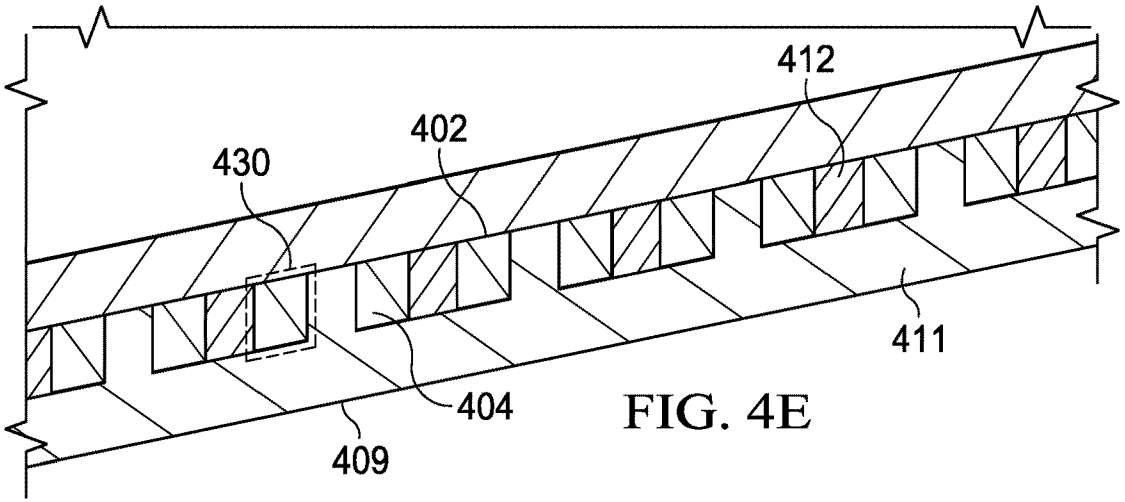
FIG. 4E depicts a close-up view of the sectional view of the ICD module FIG. 4C in accordance with one embodiment.

The embodiment of FIGS. 1A-1C illustrates a non-adjustable fixed ICD. It may be desirable however, to have the capability to adjust the configuration of an ICD. FIGS. 2A-2B are diagrammatic representations of one embodiment of an ICD device 200 with an ICD module 210 installed in a ICD container 220 in which the ICD module 210 has an adjustable fixed configuration. FIG. 2C is a diagrammatic representation of ICD module 210. FIGS. 2D-2F are diagrammatic representations of the ICD module 210 in various flow control configurations.

In accordance with one embodiment, ICD apparatus 200 includes an ICD container formed as a tubular having a tubular wall 219 defining an inner bore 299 extending axially from a first end to a second end. The ends of tubular 220 may be threaded or otherwise be adapted for connection to other tubulars in a string. In some embodiments, ICD container 220 may be formed as a tubular that can then be mounted over another tubular. A tubular inlet port 224 extends through wall 219 so that fluid may pass from the area surrounding ICD device 200 into the inner bore 299 through the tubular wall. ICD container 220 includes an ICD retaining area to retain an ICD module, such as ICD module 210, having a compatible form factor. In the embodiment illustrated, a pocket 230 is formed in the wall 219 about tubular inlet port 224. A cover 214 may complete pocket 230 to form a pocket interior. Pocket 230 has a pocket inlet port 270 from the outer surface 223 of ICD apparatus 200 to the interior of pocket 230. Tubular inlet port 224 serves as a pocket outlet port to allow fluid to flow from the interior of pocket 230 to the inner bore 299 of ICD container 220.

ICD module 210 comprises ICD body 211, regulator 212 and locking members 213. ICD body 211 may include one or more pieces formed as a plate having an inner wall 209, which may be curved to match the curve of the outer circumference of a tubular. Regulator 212 is disposed in the shaped channel. In the embodiment illustrated, ICD body 211 is adapted such that when installed, ICD inlets 215 are open to the fluid surrounding ICD apparatus 200 and ICD outlet 216 overlaps or is otherwise fluidly connected to tubular inlet port 224 so that fluid can pass from ICD module 210 into the inner bore 299.

In the embodiment illustrated, ICD module 210 provides two parallel flow paths 205. Each flow path arises from an ICD inlet 215 on either side of body 211 and terminates at a single ICD outlet 216. In the embodiment illustrated, each flow path has a lower (radially inner) wall as well as a fixed flow path wall 226 defined by body 211. The other side wall of each flow path, referred to as adjustable flow path wall 222, is defined by regulator 212. The flow path upper (radially outer) wall is defined by cover 214. In the embodiment illustrated, the walls are positioned relative to each other to define flow paths 205 therebetween with a rectangular cross sectional shape. However, the flow paths may also have other shapes.

In the embodiment shown in FIGS. 2A-2D, the fixed flow path wall 226 defined by body 211 and an adjustable flow path wall defined by regulator 212. Fixed flow path wall 226 and the adjustable flow path wall have meshing projections or teeth 217, 221 that act as diverting walls. The fixed flow path wall 226 has a plurality of spaced apart projections 221 that project laterally inward toward regulator 212 with curved valleys in between the projections. Body 211 further comprises baffles 218 between the valleys to create a series of "U" shaped paths in body 211. Regulator 212 includes teeth 217 that project laterally outward toward fixed flow path wall 226, with curved valleys between teeth 217. The spacing between the center points of each two adjacent projections 221 of body 211 is substantially the same as the distance between the center points of each two adjacent teeth 217 of regulator 212. Similarly, the distance between the center points of each two adjacent baffles 218 is substantially the same as the distance between the center points of each two adjacent teeth 217. The transition over through the valleys and from one side of the teeth/projections to the other are all generally rounded, but they could be more abrupt, with consideration as to the resulting fluid dynamics from such changes.

Regulator 212 may be positioned relative to body 211 to provide one or more of a choke flow configuration, a tortuous path configuration, or a fluidics configuration. Choked flow refers to a specific condition in which the mass flow rate of a fluid remains constant even when the downstream pressure is further reduced (assuming constant upstream pressure). Choked flow may be caused by a reduction in area of a flow path. One of ordinary skill in the art will recognize that an ICD module having a choke flow configuration may include a flow path having one or more sections of reduced area to reduce flow rate even if choked flow conditions do not exist. In other words, flow rate can be reduced even if further downstream pressure reduction results in a change in flow rate.

Regulator 212 is moveable relative to body 211 for adjusting and selecting the flow path characteristics, for example, between a choke position (see e.g., FIG. 2D), a tortuous position (see e.g., FIG. 2E), and a fluidics flow position (see e.g., FIG. 2F). A user may select the desired position and lock the regulator 212 in place by use of a locking member 213 such as locking lugs. Once locked, regulator 212 does not move with respect to the body 211. Thus, the flow paths do not change based on operating conditions in the wellbore.

As seen in FIG. 2D, in a choke flow configuration, ICD module 210 has a plurality of flow restrictions formed along the flow path where teeth 217 on the flow regulator 212 are moved to be positioned closer to one projection 221 than the other on the opposite fixed wall and closer to the projection 221 than to the adjacent baffle 218 (on the same side of the projection as the tooth 217). A series of narrow gaps (choke points) are formed between the teeth 217 of the regulator 212 and projections 221 to cause restrictions in flow through the ICD module 210. It can be noted that in the embodiment shown the downstream side of each choke point opens into an area of less constricted flow.

In contrast, the tortuous flow path configuration shown in FIG. 2E has each tooth 217 of the flow regulator 212 positioned substantially aligned with the baffles 218 between the projections 221 such that the path from inlet to outlet has substantially the same cross sectional area along its length. This can be accomplished by adjusting the flow regulator 212 to a different axial position in the channel between fixed walls in the body 211. The fluid is therefore directed through the series of "U" shaped paths, resulting in numerous directional changes in the fluid. The result of the numerous directional changes is to alter the flow through the ICD.

Yet further, as seen in FIG. 2F ICD 210 is in a fluidics device configuration. Each tooth 217 is substantially between a projection 221 and a baffle 218. Fluid flowing through the ICD 210 is split into two streams which flow around both sides of baffle 218. When the two streams converge on the other side of the baffle 218, the streams are traveling in substantially different directions. The intersection of the two streams thus causes a reduction in flow.

Although the flow path configurations are referred to as choke, tortuous, and fluidics, one skilled in the art will recognize that reduction in flow may be caused by more than one mechanism. Thus, each configuration is referred to by the primary mechanism causing the flow reduction.

Flow lines for one of the two parallel flow paths are shown in each of FIGS. 2C, 2D, and 2F with flow lines omitted for the second flow path for purposes of clarity. In operation, fluid may flow through both flow paths simultaneously.

While in the embodiment illustrated ICD module 210 is installed in pocket 230, an ICD module may be adapted for installation on the surface of an apparatus, such a tubular, without a pocket. Moreover, while in the embodiment illustrated in FIGS. 2A-2F, the flow paths 205 are formed in ICD body 211 of ICD module 210, in other embodiments the ICD container may form at least a portion of the ICD body. For example, the fixed sidewalls may be integral to tubular wall 219. In yet another embodiment, all the walls of the flow paths 205 may be formed by body 211. Furthermore, while cover 214 is illustrated as a separate cover, cover 214 may be integral to tubular wall 219.

Moreover, while the embodiment of FIGS. 2A-2F shows a particular flow path shape, one of ordinary skill in the art would recognize that the flow path can be modified as desired, for example, to add further return paths, to omit the return path, to omit the smaller turns and to replace them with alternately defined choke points, etc. In some embodiments, the flow path may be selected by replacing an ICD module with a different ICD module, such as the ICD modules discussed below.

In contrast to the ICD module 210 of FIGS. 2A-2F, which has a regulator that is adjusted to a desired position and then locked in place, other embodiments of ICDs may include a regulator that adjusts autonomously. In some embodiments, the ICD may be adjusted by changing the pressure at the surface. For example, the surface pressure can be increased, causing a change in pressure in the well. The change in well pressure may alter the position of the regulator, adjusting the flow restriction or the flow path within the ICD module.

FIGS. 3A-3E illustrate an embodiment of a dynamic progressive ICD module 310 that may automatically change flow control configurations based on operating conditions. In accordance with one embodiment, ICD module 310 may be installed in an ICD retaining area such as pocket 230 of FIGS. 2A-2B or other ICD retaining area. Depending on the configuration, an adjustable ICD such as ICD module 310 shown in FIGS. 3A-3D may be adjustable between two or more flow restriction types, including, but not limited to, choke flow, tortuous flow, and fluidics.

ICD module 310 comprises an ICD body 311, regulator 312 and biasing member 319. ICD body 311 may include one or more pieces formed as a plate having an inner wall 309, which may be curved to match the curve of the outer circumference of a tubular. The shaped channel may extend from an ICD inlet 315 to an ICD outlet 316. ICD body 311 can be adapted such that, when installed, the ICD inlets 315 will be open to the outer surface of apparatus in which ICD module 310 is installed (e.g., open to the fluid surrounding a tubular in which ICD module 310 is installed) and ICD outlet 316 will be fluidly connected to an inlet port (e.g., tubular inlet port 224 of FIG. 2B).

In the embodiment illustrated, ICD module 310 provides two parallel flow paths. Each flow path arises from an ICD inlet 315 on either side of body 311 and terminates in a single ICD outlet 316. The flow path lower (radially inner) wall 304 as well as fixed flow path wall 326 is defined by body 311. The other side wall of each flow path, adjustable flow path wall 322, is defined by regulator 312 and flow path upper (radially outer) wall 302 is defined by cover 314. In the embodiment illustrated, the walls are positioned relative to each other to define flow paths 305 therebetween with a rectangular cross sectional shape. However, the flow paths may also have other shapes.

The side walls of the flow path are defined by an adjustable flow path wall 322 formed by regulator 312 and a fixed flow path wall 326 formed in body 311. The fixed flow path wall 326 of body 311 has a plurality of spaced apart projections 321 that project laterally inward toward regulator 312 with curved valleys in between projections 321. Body 311 further comprises baffles 318 between the valleys to create a series of "U" shaped paths in body 311. The facing wall of regulator 312 includes teeth 317 that project laterally outward toward fixed flow path wall 326 with curved valleys between teeth 317. The spacing between the center points of each two adjacent projections 321 of body 311 is substantially the same as the distance between the center points of each two adjacent teeth 317 of regulator 312. Similarly, the distance between the center points of each two adjacent baffles 318 is substantially the same as the distance between the center points of each two adjacent teeth 317. The transition over through the valleys and from one side of the tooth/projections to the other are all generally rounded, but they could be more abrupt, with consideration as to the resulting fluid dynamics from such changes.

As with ICD module 210 of FIGS. 2A-2F, axial movement of the flow regulator 312 relative to body 311 changes the geometry of the fluid path. Regardless, however, of the relative position of the flow regulator 312 within the body 311, the fluid path in the illustrated embodiment remains rectangular in cross section as shown by the outline 330 in FIG. 3D. In other embodiments, however, the flow paths may have different geometries.

Flow regulator 312 can move dynamically by fluid pressure acting against the bias in a biasing member 319. The biasing member 319 in the illustrated embodiment is a spring formed by at least one spring rod installed between body 311 and flow regulator 312. Biasing member 319 is retained in a cavity 303 having a prolate spheroid shape. The shape of cavity 303 may be configured to control movement of the biasing member. For example, the cavity 303 may be wider or narrower or have a different shape such as a semielliptical shape.

Fluid passing through the inlets 315 and the flow paths 305 applies a friction or force against the flow regulator 312. Biasing member 319 normally maintains the flow regulator in a neutral position but if the pressure at inlets 315 increases, biasing member 319 allows the flow regulator 312 to shift within body 311. Increased pressure may cause the flow regulator 312 to move from tortuous path configuration to a fluidics device configuration to a choke configuration to reduce the flow through the ICD module 310. If conditions moderate, biasing member 319 moves the flow regulator 312 back toward the neutral position. The response of the ICD may be easily varied prior to installation, for example, by installing fewer or more springs, or springs having different stiffness or spring rates or by magnets interacting with other magnets creating resistance for the regulator 312 to move.

As will be appreciated, this ability of ICD module 310 to transition between tortuous, fluidic and choke flow configurations may permit automatic response to down hole conditions such as a gas or water break through. The ability to change in-situ from choke to tortuous flows or combinations thereof, is also useful when converting from producer (flow into the apparatus) to injector (flow out of the apparatus) or between oil and gas.

An automatically adjustable ICD module may be adapted for installation on the surface of an apparatus, such a tubular, with or without a pocket. Moreover, while in the embodiment illustrated in FIGS. 3A-3E, the flow paths 305 are formed by body 311, the ICD container may form at least a portion of the ICD body. For example, the fixed sidewalls may be integral with a tubular wall. In yet another embodiment, all the walls of the flow paths 305 may be formed by body 311 of the ICD module. Furthermore, while cover 314 is illustrated as a separate cover, cover 314 may be integral to the tubular in which ICD module 310 is installed.

Moreover, while the embodiment of FIGS. 3A-3E shows a particular flow path shape, one of ordinary skill in the art would recognize that the flow path can be varied as desired, for example, to add further return paths, to omit the return path, to omit the smaller turns and to replace them with alternately defined choke points, etc.

FIGS. 4A-4E illustrate another embodiment of dynamic regressive ICD module 410 having a relatively high pressure drop. ICD module 410 can have an ICD body formed integral with an apparatus, such as a tubing string tubular, or a body that can be installed on the wall of an apparatus, with or without a pocket. According to one embodiment, ICD module 410 includes an ICD body 411, regulator 412 and biasing member 419. In the illustrated embodiment, ICD body 411 comprises one or more pieces formed as a plate having an inner wall 409, which may be flat or curved (e.g., curved to match the curve of the outer circumference of a tubular). ICD body 411 is adapted such that, when installed, the ICD inlet 415 will be open to the outer surface of the apparatus in which ICD module 410 is installed (e.g., open to the fluid surrounding a tubular in which ICD 410 is installed) and ICD outlet 416 will be fluidly connected to an inlet port (e.g., tubular inlet port 180 of FIG. 1A). Depending on the starting configuration, the resulting pressure drop may be regressive (i.e.: reduce when a certain pressure drop is reached). The starting position can be fully closed or open to some degree. This feature can allow for one or more ICD to allow more flow when the downhole flowing pressure is decreased.

ICD module 410 provides a flow path 405 that arises from ICD inlet 415 on the side of body 411 and terminates at ICD outlet 416. The flow path lower (radially inner) wall 404 as well as one side wall, fixed flow path wall 426, is defined by body 411. The other sidewall of the flow path, sidewall 422, is defined by regulator 412 and the flow path upper (radially outer) wall 402 is defined by cover 414. In the embodiment illustrated, the walls are positioned relative to each other to define a flow path 405 therebetween with a rectangular cross sectional shape. However, the flow path may also have other shapes.

ICD module 410 of FIGS. 4A-4D has a flow regulator 412 that can move dynamically by fluid pressure acting against the bias in biasing member 419. As with the ICD of FIGS. 2A-2E, axial movement of the flow regulator 412 relative to body 411 changes the geometry of flow path 405. Regardless, however, of the relative position of the flow regulator 412 within the body, the flow path in the illustrated embodiment remains rectangular in cross section as shown by the outline 430 in FIG. 4D. It is noted that the configuration of FIG. 4D defines a tortuous path, where the cross sectional area remains substantially consistent along the flow path length. However, a choke flow configuration could be obtained by moving flow regulator 412 to bring each tooth 417 thereon closer to one projection 421 than another projection on the body 411.

One or more biasing members 419 may bias regulator 412 toward a neutral position. In the illustrated embodiment, biasing member 419 is retained in a cavity 403 having a prolate spheroid shape. The shape of cavity 403 may be configured to control movement of the biasing member. For example, the cavity 403 may be wider or narrower or have a different shape such as a semielliptical shape. The biasing member in the illustrated embodiment is a spring formed by a plurality of spring rods installed between body 411 and flow regulator 412. However, other biasing members may be used.

In operation, fluid passing through the inlet 415 and the flow path 405 applies a friction or force against the flow regulator 412. Biasing member 419 normally maintains the flow regulator in a neutral position but if the pressure at inlet 415 increases, biasing member 419 allows the flow regulator 412 to shift within body 411. Increased pressure may cause the flow regulator 412 to move from tortuous path to a choke configuration to reduce the flow through ICD 410. If conditions moderate, the biasing member 419 moves the flow regulator 412 back toward the neutral position. The response of the ICD may be easily varied prior to installation, for example, by installing fewer or more springs, or springs having different stiffness or spring rates.

While, in the embodiment illustrated in FIGS. 4A-4E, the flow paths 405 are formed by body 411 of ICD module 410, in other embodiments the ICD container may form at least a portion of the ICD body. For example, fixed sidewalls of flow paths 405 may be integral to a tubular in which regulator 412 is installed. In yet another embodiment, all the walls of the flow paths 405 may be formed by body 411 of ICD module 410. Furthermore, while cover 414 is illustrated as a separate cover, cover 414 may be integral to tubular in which ICD 410 is installed.

Moreover, while the embodiment of FIGS. 4A-4E shows a particular flow path shape, one of ordinary skill in the art would recognize that the flow path can be varied as desired, for example, to add further return paths, to omit the return path, to omit the smaller turns and to replace them with alternately defined choke points, etc.

Figure 5A:
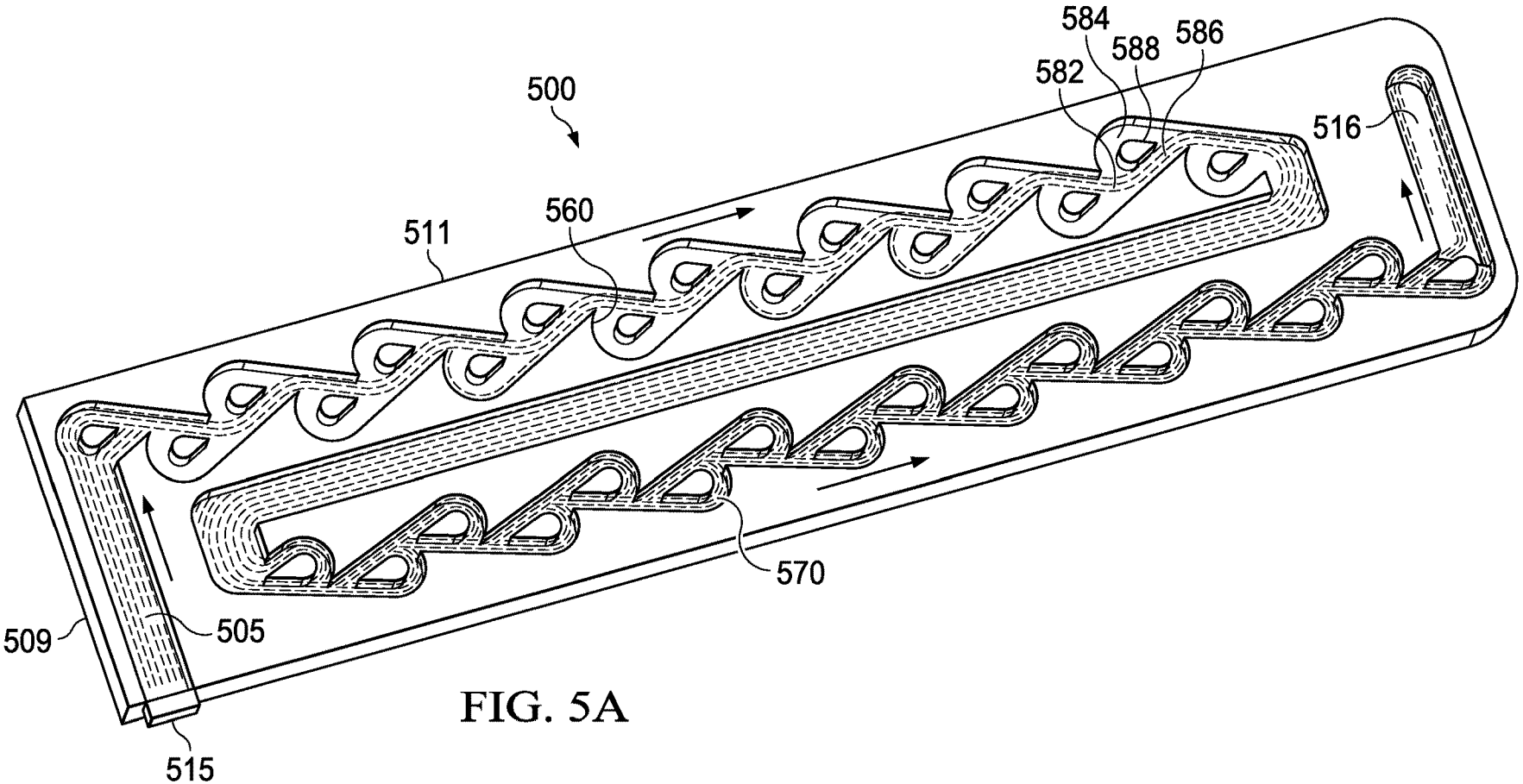
FIG. 5A depicts a diagrammatic representation of an ICD module having a Tesla profile according to one embodiment.
Figure 5B:
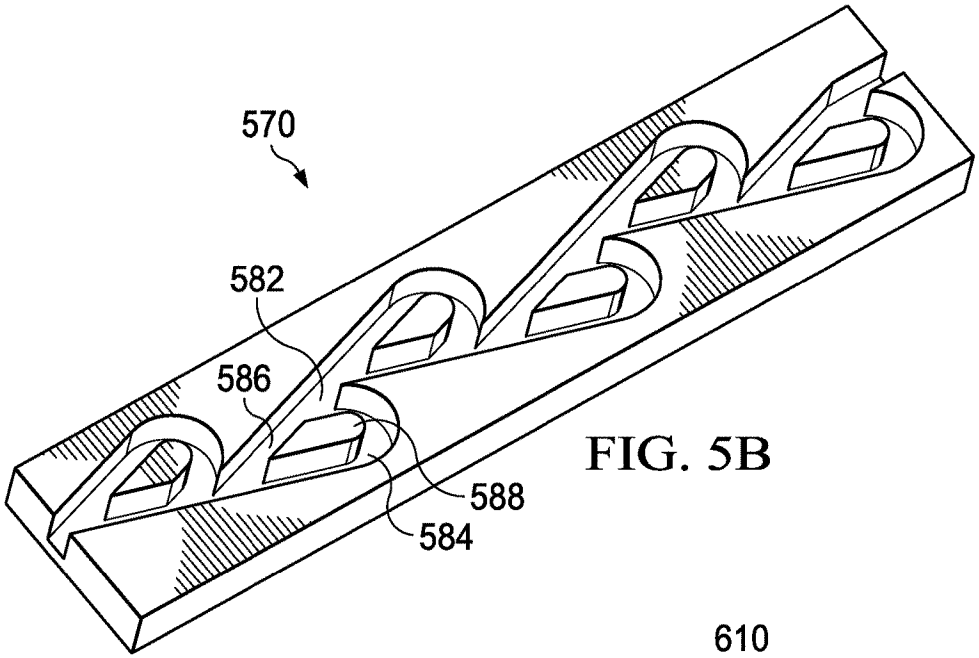
FIG. 5B depicts a close-up view of the ICD module of FIG. 5A in accordance with one embodiment.

FIGS. 5A-5B illustrate yet another ICD module design. ICD module 500 of FIG. 5A that may be installed or formed integral in a tubular. ICD module 500 comprises a body 511 formed from one or more components. In accordance with one embodiment, ICD body 511 comprises a plate having an inner wall 509, which may be curved to match the curve of the outer circumference of a tubular. Body 511 has an inlet 515 and an outlet 516 defined in body 511.

ICD module 510 comprises a Tesla valve allowing for a fluid to flow preferentially (or entirely) in one direction without requiring moving parts. In the embodiment illustrated, ICD module 500 for a combination of two opposing Tesla profiles 560, 570 defined in series (FIG. 5B shows an enlarged view of a portion of Tesla profile 570). Tesla profile 560, 570 may be the same the same profiles in opposing directions or be different opposing profiles. The opposing Tesla profiles 560, 570 of ICD module 500 can be selected to accomplish and control a pressure drop in one flow direction and another controlled pressure drop in an opposite flow direction. By combining different Tesla profiles in opposing directions a significant improvement is achieved by providing much greater regulation of flow in both directions.

In the illustrated embodiment, Tesla profile 560 provides flow through configuration to allow unimpeded or minimally impeded flow in the inflow direction (flow not impeded or minimally impeded by reversed flow about dividers 588). As can be seen in FIG. 5A, when fluid flows from inlet 515 to outlet 516, the flow weaves through flow control features 560 with minimal interaction with dividers 588. Tesla profile 570 on the other hand has a resistance configuration in which return flow impedes inflow to provide resistance. When the flow reaches Tesla profile 570, the dividers 588 of flow Tesla profile 570 splits the flow into two portions, one through forward flow path 586 and one through return flow path 584. Return flow path 584 is looped back against forward flow path 586. The interaction of the flow at convergence zone 582 causes greater flow resistance. In the opposite direction, Tesla profile 570 provides a flow through configuration while Tesla profile 560 provides a resistance configuration. Thus, the embodiment of FIGS. 5A-5B combines a flow through configuration with a resistance configuration in both directions. The Tesla profiles can be adapted such that module 500 provides more resistance in one direction than the other (e.g., more resistance to outflow than inflow or vice versa).

ICD module 500 may be installed in a tubular (not shown) with inlet 515 open to the outside of the tubular. Outlet 516 may be aligned with an opening in a tubular to allow fluid to flow out of outlet 516 and into an inner bore of a tubular. Flow path 505 through the ICD may be enclosed by use of a cover similar to cover 414 of FIG. 4 or may be enclosed by a wall of a tubular when the ICD 500 is inserted into a pocket of the tubular. Thus, in operation, fluid may flow from outside the tubular, through inlet 515, flow control features 560 and 570, through outlet 516, and into an inner bore of a tubular via a tubular inlet. In other embodiments, the Tesla profiles may be formed integral with a tubular or other device.

Figure 6A:
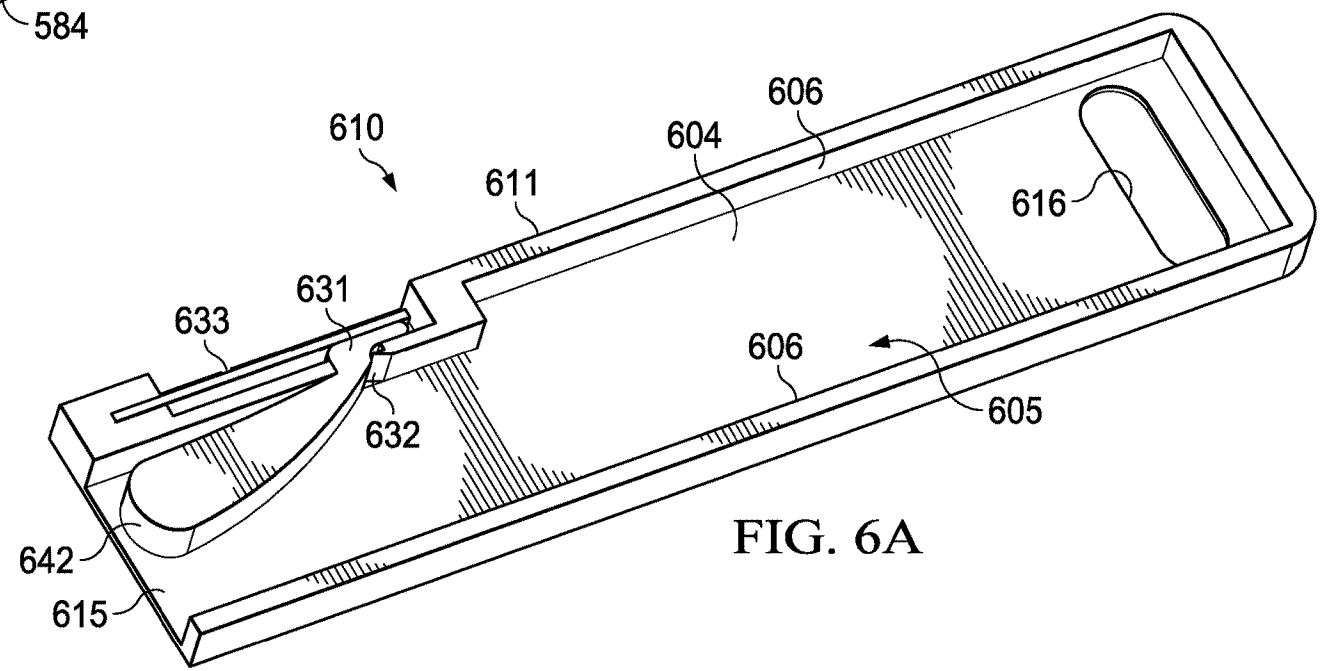
FIG. 6A depicts a diagrammatic representation of a dynamically adjustable ICD module having a hydrodynamic regulator in accordance with one embodiment.
Figure 6B:
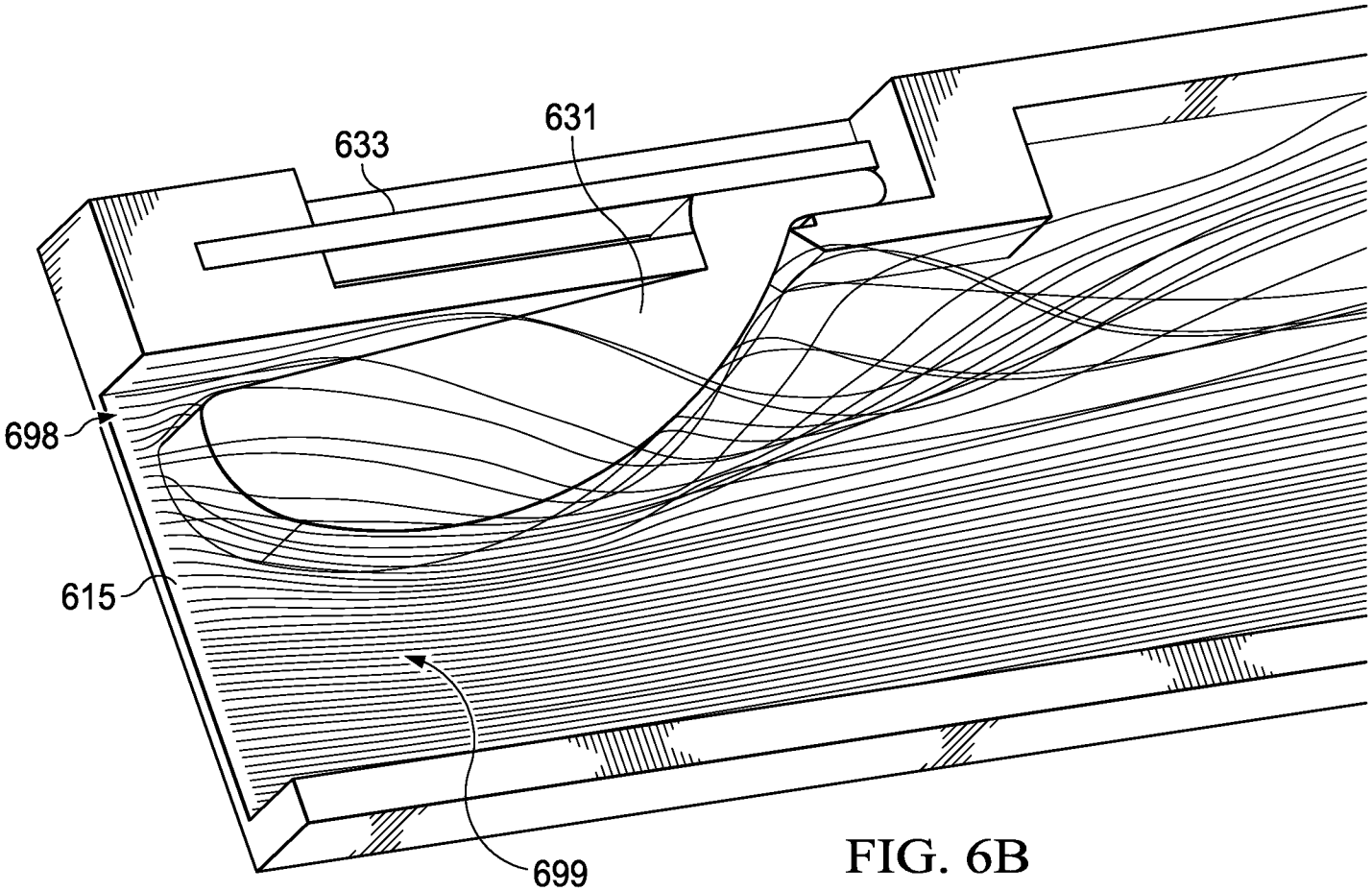
FIG. 6B depicts a simulation of fluid flow in a dynamically adjustable ICD module having a hydrodynamic regulator in accordance with one embodiment.

FIGS. 6A-6B illustrate another embodiment of an ICD module 610 that can be installed in an ICD container. The illustrated ICD module 610 can have the body formed integral with an apparatus such as a tubing string tubular or the body can be installed on the wall of an apparatus (not shown), with or without a pocket. In one embodiment, ICD module 610 comprises body 611, a regulator 631 and a biasing member 633. ICD body 611 may include one or more pieces formed as a plate having a bottom wall 604, which may be curved to match the curve of the outer circumference of a tubular, and sidewalls 606 that define a flow path 605 on the outer side of ICD body 611. The flow path may extend from an ICD inlet 615 to an ICD outlet 616. ICD body 611 is adapted such that, when installed, the ICD inlet 615 will be open to outer surface of the tubular (open to the fluid surrounding the wellbore apparatus in which ICD module 610 is installed) and ICD outlet 616 will be fluidly connected (e.g., aligned or otherwise fluidly connected) to a tubular inlet port (e.g., tubular inlet port 224 of FIG. 2B).

The ICD includes walls that define a flow path. The walls of the flow path are rectangularly configured, with opposing, substantially parallel side walls 606 and a bottom wall 604 opposite a top wall. The top wall is not shown but will be present by a cover either by way of a top plate installed on the body 611 or by way of an outer wall of a pocket in which the body 611 is installed. While the walls are rectangularly configured, they may have other geometries.

The ICD 610 of FIGS. 6A-6B has a flow regulator 631 installed in flow path 605. The flow regulator 631 is installed with a moveable connection 632. As such, it remains secured within the flow path 605 but can move, for example, hydrodynamically by fluid pressure acting it. More particularly, flow regulator 631 has a configuration such as surface curvature and/or material selection that creates a hydrodynamic effect as fluid moves therepast. The hydrodynamic effect alters the drag and thereby the pressure profile of fluid that flows therepast to exploit and amplify the forces and other characteristics of the fluid flowing through the ICD module 610. For example, one or more surfaces of the regulator may have surface texturing, profiling, material selection, hydrophilic properties or hydrophobic properties to create a desired frictional response (i.e. drag) between the regulator 631 and fluid passing thereby.

In accordance with one embodiment, flow regulator 631 may comprise a shape configured to create a hydrodynamic force normal to the surface as fluid flows past flow regulator 631 in the flow path 605. For this reason, the regulator 631 may be referred to as a "wing" and the ICD module 610 referred to as a "wing-type" ICD. In particular, the regulator 631 may include a surface curvature defining an airfoil shape exposed in the flow path 605 adapted to create a high pressure region 698 and a low pressure region 699 around the regulator 631. The airfoil shape may be symmetrical or may have camber, as shown. While the airfoils of FIGS. 6A-6B have flattened upper and lower surfaces with only the perimeter surfaces shaped as an airfoil, the curvature could be continued about further surfaces of the regulator 631, if desired. In any event, the airfoil shape can be configured so that regulator 631 responds to fluid flow characteristics to generate hydrodynamic movement to alter flow path 605. The shape may be selected to create a desired response. As such, it can be noted that the regulator 631 in the embodiment of FIG. 6A has a slightly different cambered airfoil shape than FIG. 7 to create a different response.

In the illustrated embodiment, ICD module 610 includes a biasing member 633, such as a spring or other biasing member, which biases the flow regulator 631 into a neutral position. The biasing member 633, here shown as a spring rod, is installed between the body 611 and the flow regulator 631. Fluid passing through the inlet 615 and along the flow path 605 applies a pressure against the flow regulator 631. The biasing member 633 normally maintains the flow regulator 631 in a neutral position but if the pressure at inlet 615 increases, biasing member 633 allows the flow regulator 631 to shift within the body 611. Increased pressure may cause the flow regulator 631 to move into a choke position to reduce the flow through the ICD 610. The moveable connection 632 in this embodiment is a pivotal connection, allowing rotational movement (arrow R) about the movable connection 632.

Figure 7:
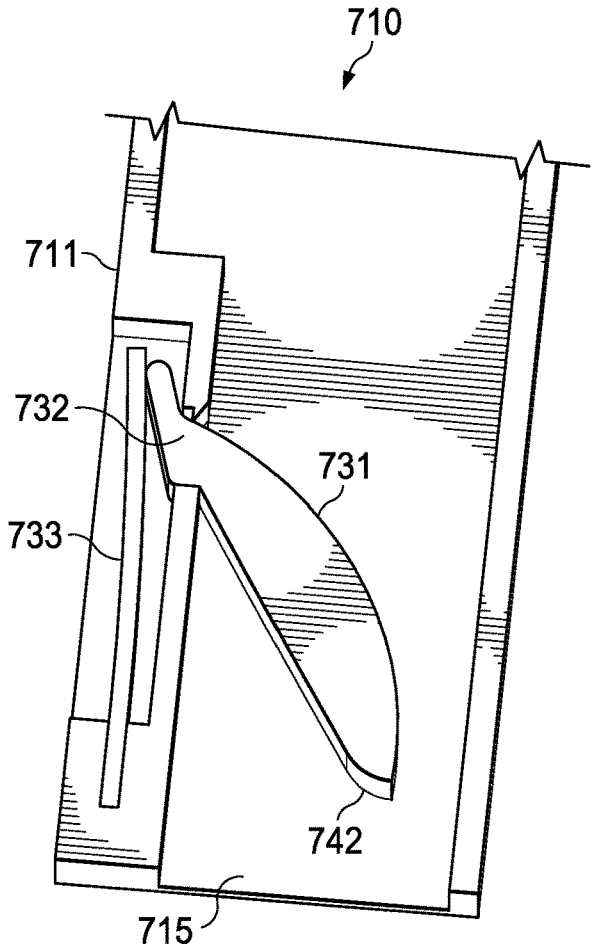
FIG. 7 depicts a diagrammatic representation of a portion of a dynamically adjustable ICD module having a hydrodynamic regulator in accordance with one embodiment.

Flow regulator 631 thus rotates about connection 632 to change the distance between the flow regulator and opposite wall 606, thereby changing the cross-sectional area of the flow path in that area. As will be appreciated, the regulator 631 may pivot against the bias in the biasing member 633 about the pivotal connection 632 towards a low pressure region 699 generated by fluid flowing over the airfoil shape. In one embodiment, regulator 631 moves from a neutral position (FIG. 6A) with the leading end 642 of the airfoil shape positioned alongside the near side wall 606 to a position where the leading end 642 of the airfoil shape extends out in the center of the flow path 605 (as shown in the example of FIG. 7). This embodiment produces a force and load amplification by utilizing hydrodynamic effects that may cause regulator 631 to move based on changes in density, viscosity, turbulence, etc.

It can be noted that, a wing-type ICD causes increased sensitivity to changes in fluid density, providing sensitivity to water production. When crude is flowing a certain hydrodynamic force is exerted on regulator 631. When water production starts, the water has a higher density than the crude and will increase the force/load on the wing, causing it to move to reduce the total flow rate.

FIG. 6B shows typical flow dynamics past the regulator 631, with lower pressure regions shown by closely spaced lines and lower fluid pressure areas shown by more greatly spaced lines. If conditions moderate and the biasing force of biasing member 633 overcomes the hydrodynamic force from fluid flow, the biasing member 633 moves the flow regulator 631 back to the neutral position. As will be appreciated, this ability of the ICD to act as a valve to transition from an open, substantially unchoked condition to a choked, substantially closed condition may permit automatic response to downhole conditions such as a gas or water break through. The ability to change in situ between choked and unchoked flows, is also useful when converting from producer (flow into the apparatus) to injector (flow out of the apparatus) or between oil and gas.

The flow regulator 631 may be configured to be hydrophilic, to have improved water wetting features, or have other properties. For example, the flow regulator 631 may have all or a portion of its surface adapted or formed of a hydrophilic material. By making the surface of the regulator 631 hydrophilic, water will generate a higher friction (i.e. drag) across the regulator 631 than other fluids such as oil or gas. As such, the regulator 631 may move more when water flows through the flow path 605 than when non-aqueous fluids flow through the flow path 605. Water flows may, therefore, tend to force the regulator 631 readily into a choking position to selectively stop water production.

The regulator 631 may be shaped to have a thickness substantially the same as the flow path 605 to substantially block flow from passing above or below the regulator 631. However, as shown, the thickness of the regulator 631 may be slightly less than the flow path 605 such that there may be some clearance above and/or below the regulator 631, to ensure that there is always some flow therepast even if the regulator 631 is pivoted or breaks off and becomes positioned entirely across the flow path.

FIG. 7 shows another embodiment of an ICD module 710 similar to ICD 610 of FIGS. 6A-6B with one principal difference being that regulator 731 is shaped differently than regulator 631 of FIGS. 6 A-6B. Regulator 731 has a leading edge pointing toward inlet 715 of ICD 710 and is movably attached to body 711 be pivotal connection 732. A biasing member 733, such as a spring or other biasing member, provides biasing force to urge regulator 731 into a neutral position. Fluid flowing past regulator 731 may create conditions sufficient to overcome the biasing force produced by biasing member 733 and cause regulator 731 to move about pivotal connection 732, as shown in FIG. 7. Regulator 731 may obtain a stable position where the forces generated by the fluid balance the force of biasing member 733.

Figure 8:
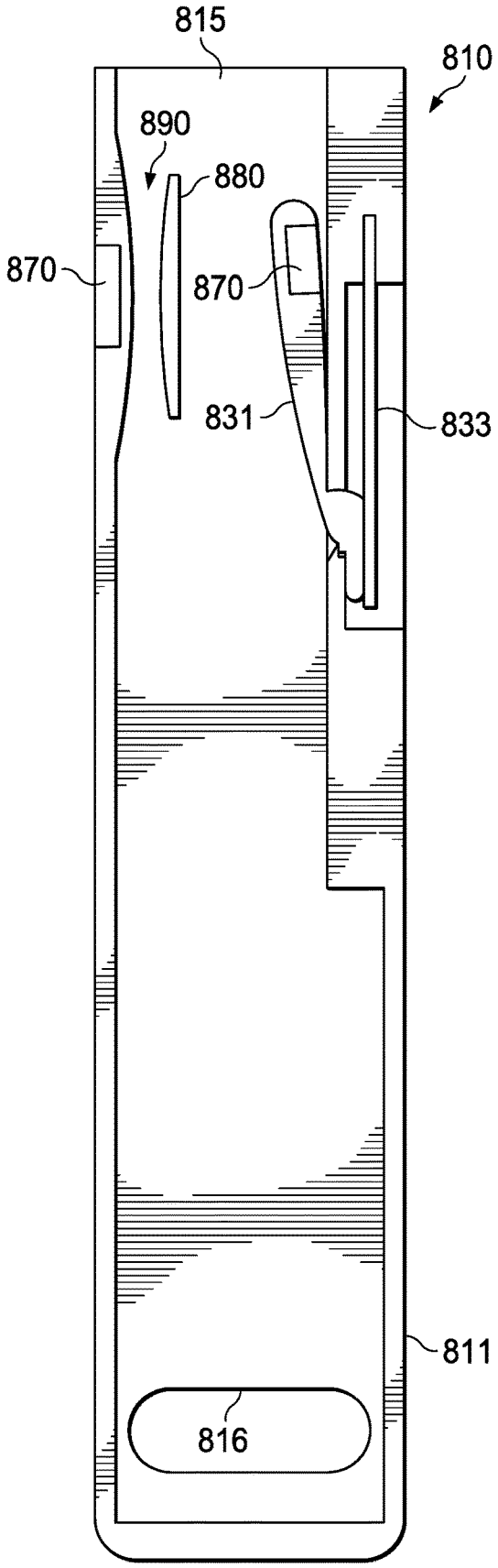
FIG. 8 depicts a top view of a dynamically adjustable ICD module having a hydrodynamic regulator in accordance with one embodiment.

FIG. 8 shows yet another embodiment of a dynamically adjustable ICD. ICD module 810 may be referred to as a low-viscosity autonomous ICD. Similar to the embodiments of FIGS. 6 and 7, ICD module 810 utilizes a hydrodynamic "wing" that can move within the body 811 to regulate flow. In addition to biasing member 833, the regulator 831 and the body 811 each have 1 or more magnets 870 embedded therein or the regulator 831 or body 811 may be made entirely from magnetic materials. As the regulator 831 moves toward the center of the ICD 810, the fluid flowing therethrough may increase the pressure on the regulator 831. This increase in pressure creates additional force on the regulator, causing the regulator to move even more, resulting in even more pressure on the regulator. Thus even slight movement of the regulator 831 might cause the regulator 831 to snap from a resting position to a fully pivoted position. Magnets 870 can be configured to act with biasing member 833 to further control the response of regulator 831, such as by preventing the regulator from snapping to a fully pivoted position, allowing the regulator 831 to move continuously along the regulator's range of movement. Also, as seen in FIG. 8, ICD module 810 may also contain a baffle 880 that defines a passage 890 for fluid to flow from inlet 815 to outlet 816 even if regulator 831 has fully deployed. Additionally, the baffle 880 can act as a stop to limit the regulator's range of motion.

It can be noted that embodiments of ICDs, may use electro magnets. Electric conductivity of crude oil is substantially different than that of water. Thus by placing electro magnets in body 815 (or the bodies of ICD modules 610, 710) or in the regulator 631, 731, 831 and providing a small electric current either from a permanent source or a battery, the magnets can be activated in response to water or a water portion flowing through the ICD module. This can then cause the regulator to move and the flow through the ICD module to be adjusted. In some embodiments, batteries or power generators can be housed in modules adapted to fit in an ICD container (e.g., batteries or power generators can be housed in empty of pockets of an ICD device having multiple pockets).

FIGS. 9A and 9B show another embodiment of an ICD with a hydrodynamically movable regulator. The illustrated ICD can have the body formed integral with an apparatus such as a tubing string tubular or the body can be installed on the wall of an apparatus (not shown), with or without a pocket. In one embodiment, an ICD module 910 can be provided comprising a body 911 formed from one or more components. In accordance with one embodiment, ICD body 911 comprises a plate having an inner wall 909, which may be curved to match the curve of the outer circumference of a tubular. Body 911 has an inlet 915 and an outlet 916 defined in body 911. Regulator 931 is connected to body 911 by a movable connection 932. In this embodiment, the movable connection is a pivotal connection. Regulator 931 is comprised of a forward portion 941 and a rearward portion 942 connected to movable connection 932 by a bridge 943. Each of the forward portion 941 and the rearward portion 942 may have an airfoil (or hydrofoil) shape which may generate forces in response to a fluid flowing therepast.

Figure 11:
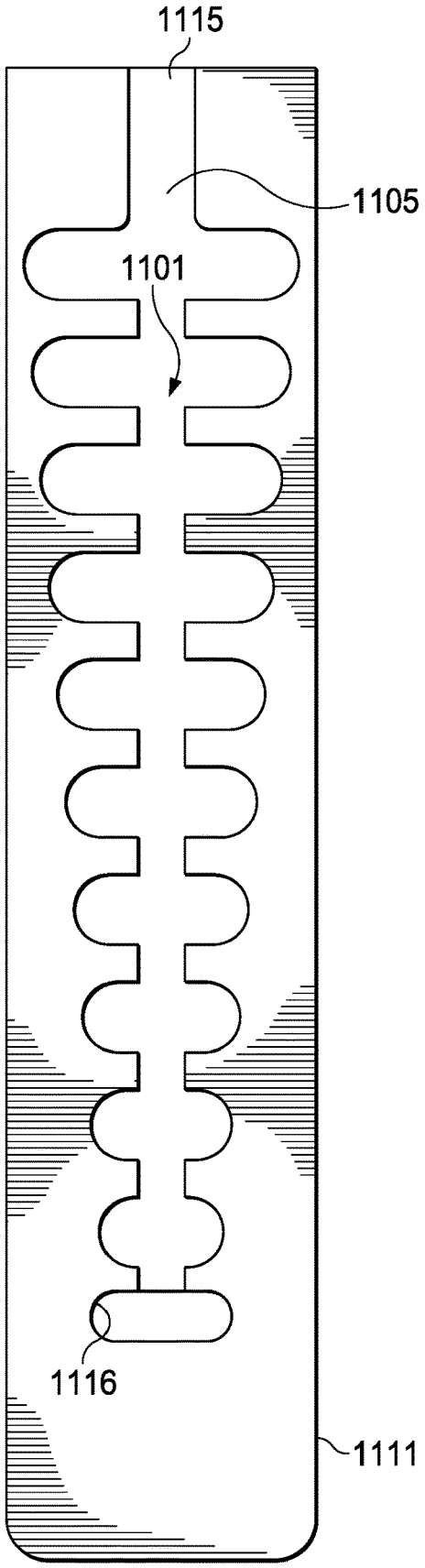
FIG. 11 depicts a top view of a fixed ICD module with nozzles in series in accordance with one embodiment.
Figure 12:
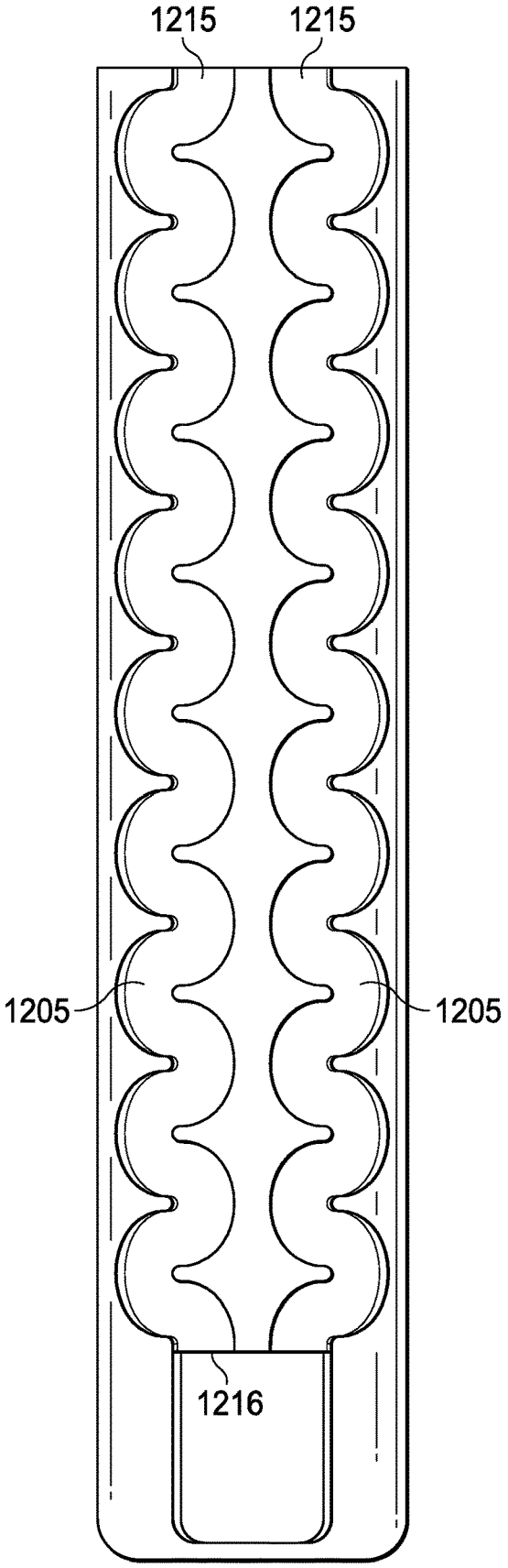
FIG. 12 depicts a top view of a fixed ICD module having tortuous flow paths in accordance with one embodiment.
Figure 13:
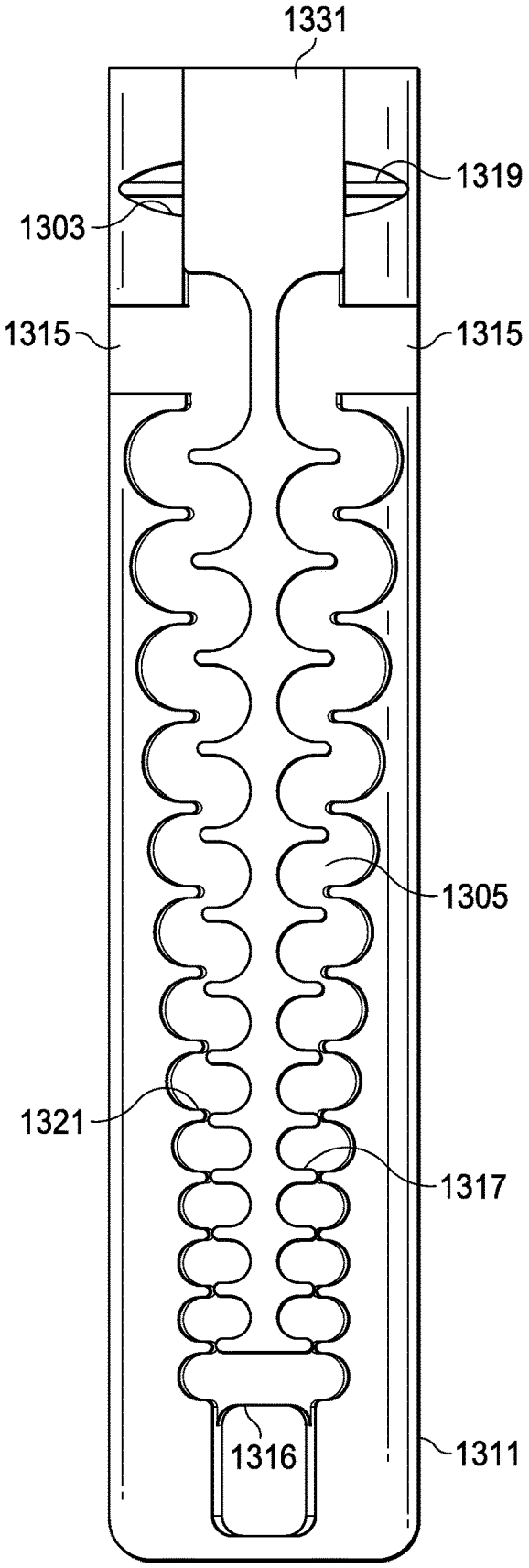
FIG. 13 depicts a top view of a dynamically adjustable ICD module in accordance with one embodiment.
Figure 14:
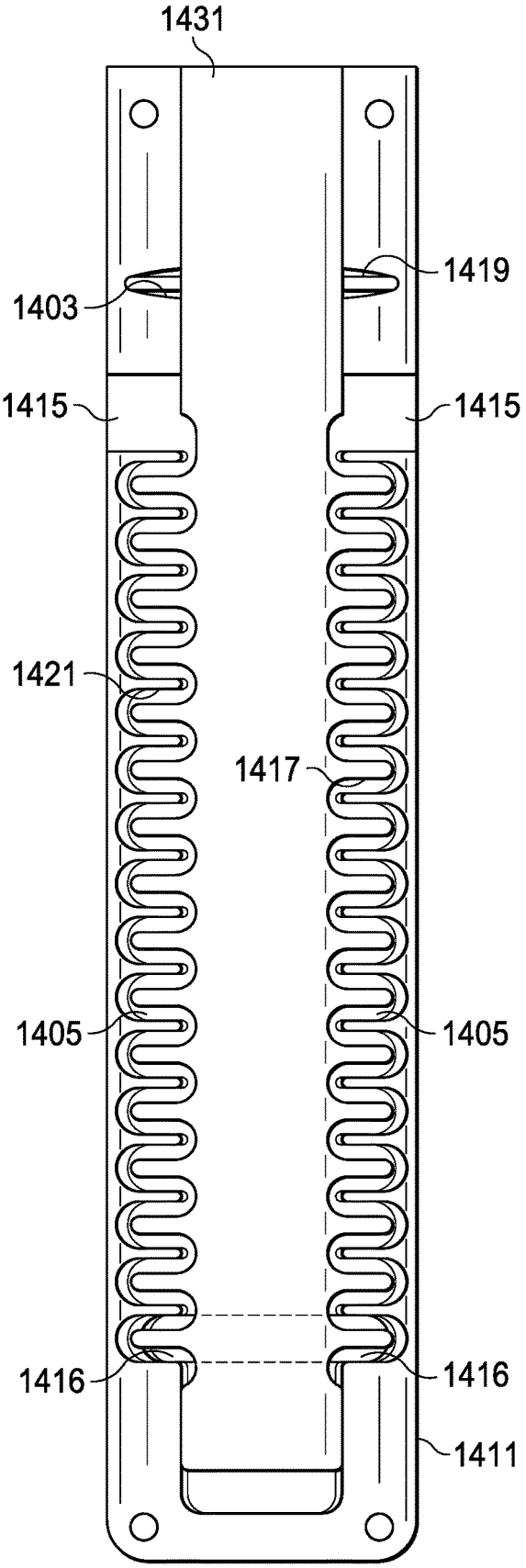
FIG. 14 depicts a top view of a dynamically adjustable ICD module in accordance with one embodiment.
Figure 15:
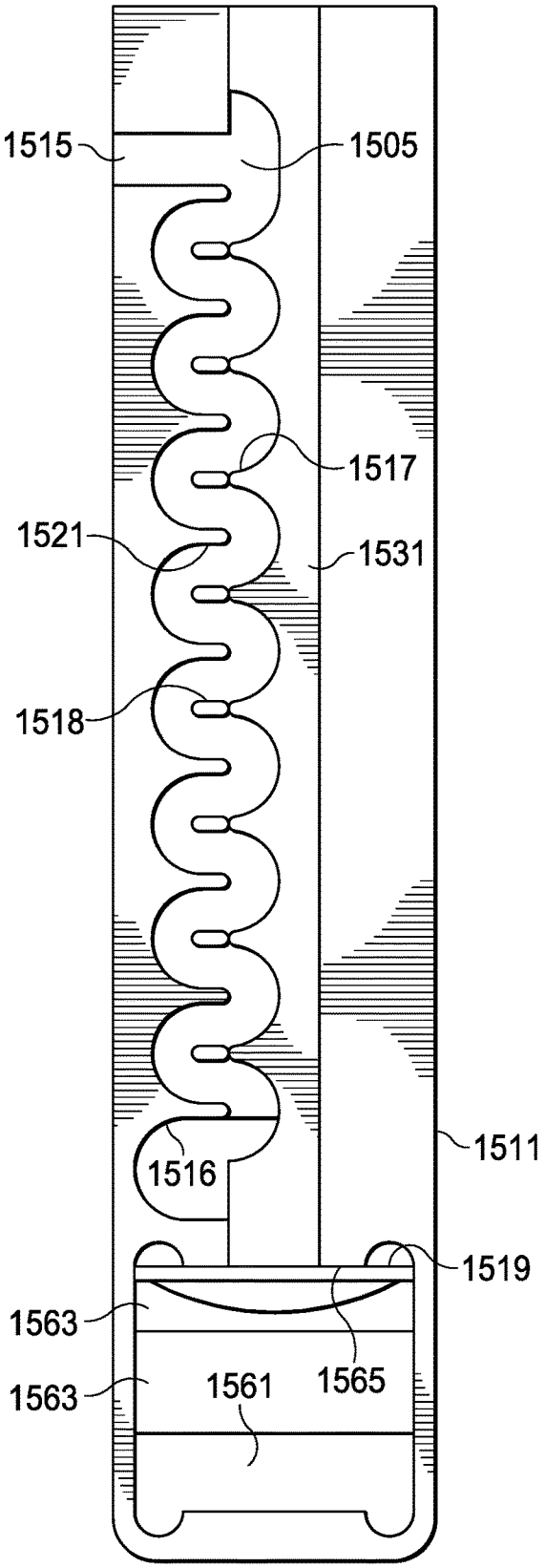
FIG. 15 depicts a top view of a dynamically adjustable ICD module in accordance with one embodiment.

Forward portion 941 and rearward portion may have a thickness approximately equal to the height of the flow path through body 911. Bridge 943 may have a thickness less than that of the height of the flow path through the body to allow fluid to flow between the forward portion and rearward portion. As fluid flows from the inlet 915 to the outlet 916, the fluid passes over the forward portion 941 and rearward portion 942 of regulator 931. Movement of the fluid across the regulator may create hydrodynamic forces which cause forward portion 941 and rearward portion 942 to pivot around movable connection 932. In one embodiment, forward portion 941 and rearward portion 942 move independently. In another embodiment, forward portion 941 and rearward portion 942 move together as a single unit. As forward portion 941 or rearward portion 942 pivots in the body 911, the amount of restriction in the flow through the ICD changes. By specifically configuring the regulator, restriction can be adjusted based on fluid type, flow rate, etc. to produce a desired flow into the wellbore. The amount of restriction can be regulated with one or more magnets mounted in regulator 931 and the body 911. Optionally some magnets may be mounted in other parts of the ICD device FIGS. 10-15 illustrate additional embodiments of ICD modules, each of which could be installed independently in an ICD container, for example on the outer surface of a tubular or in a pocket. In other embodiments, portions of the ICDs may be formed integral to the tubular. In the embodiments illustrated, ICD modules may be provided that have a similar exterior form factor but different internal flow passages. While various outlet shapes and positions are shown, tubulars and the ICDs may be configured for maximum compatibility. FIGS. 10-12 show examples of fixed ICDs in which the flow path cannot be adjusted. FIGS. 13-15 show examples of adjustable ICDs in which the flow path may change in operation. The embodiments of FIGS. 13-15 may also be configured as adjustable-fixed ICDs similar to the ICD of FIGS. 2A-2E.

In the embodiment shown in FIG. 10, a body 1011 defines a flow path 1005 including a plurality of nozzles 1001. The nozzles 1001 are in parallel and are fluidly connected to inlet 1015 and outlet 1016. In the illustrated embodiment, the nozzles 1001 are identical. In other embodiments, the nozzles 1001 may have different configurations. For example, nozzles further away from inlet 1015 may be smaller.

In the embodiment shown in FIG. 11, a body 1111 defines a flow path 1105 that includes a plurality of nozzles 1101. The nozzles 1101 are in series and are fluidly connected to inlet 1115 and outlet 1116 to define a flow path 1105 therein. In the illustrated embodiment, the nozzles 1101 become progressively smaller toward outlet 1116. In other embodiments, the nozzles may have different configurations.

FIG. 12 shows an embodiment of an ICD having fixed tortuous flow paths 1205. By using two flow paths 1205, the flow rate can be greater than with a single flow path. Flow paths 1205 are fluidly connected to inlets 1215 and outlet 1216 and include a number of directional changes to restrict flow therethrough.

In the embodiment shown in FIG. 13, an adjustable regulator 1331 may be slidably mounted in a body 1311 to define two flow paths 1305 between inlets 1315 and outlet 1316. A biasing member 1319, such as a spring, may hold regulator 1331 in a neutral position. Biasing member 1319 is retained in a cavity 1303 having a prolate spheroid shape. The shape of cavity 1303 may be configured to control movement of the biasing member. For example, the cavity 1303 may be wider or narrower or have a different shape such as a semielliptical shape. Body 1311 has a series of projections 1321 with "U" shaped valleys in between. Likewise, regulator 1331 has a series of teeth 1317 with "U" shaped valleys in between.

As can be seen in FIG. 13, the flow path 1305 defined between the regulator 1331 and the body 1311 gets progressively smaller from the inlet 1315 toward the outlet 1316. Also, the spacing of the teeth 1317 of the regulator 1331 and the projections 1321 of the body 1311 are not equal between the two components. For example, notice that near the inlets 1315, the teeth 1317 are substantially centered between the projections 1321. By contrast, near the outlet 1316, the teeth 1317 and projections 1321 are substantially aligned. Thus, near inlet 1315 the flow path is tortuous but near outlet 1316 the flow path becomes choked. However, if regulator 1331 moves with respect to body 1311, such as by a change in conditions, the teeth 1317 may move away from the projections 1321 near outlet 1316. At the same time, near inlets 1315, teeth 1317 move closer to projections 1321. Thus, the flow path 1305 near the inlets 1315 may become choked while the flow path 1305 near the outlet 1316 may become tortuous. Because the device may progressively limit flow through the ICD module as the regulator 1331 is moved from the neutral position, the device of FIG. 13 may be referred to as a dynamic progressive device.

In the embodiment shown in FIG. 14, an adjustable regulator 1431 may be slidably mounted in a body 1411 to define two flow paths 1405 between inlets 1415 and outlet 1416. A biasing member 1419, such as a spring, may hold regulator 1431 in a neutral position. Biasing member 1419 is retained in a cavity 1403 having a prolate spheroid shape. The shape of cavity 1403 may be configured to control movement of the biasing member. For example, the cavity 1403 may be wider or narrower or have a different shape such as a semielliptical shape. Body 1411 has a series of projections 1421 with "U" shaped valleys in between. Likewise, regulator 1431 has a series of teeth 1417 with "U" shaped valleys in between. The teeth 1417 are within and substantially centered between the projections 1421. Thus, the flow path 1405 defined between the regulator 1431 and the body 1411 is a tortuous flow path. If regulator 1431 is moved with respect to body 1411, the teeth 1417 will move closer to one projection 1421 than another creating a choke flow configuration. Even in a choke flow configuration the flow path still contains numerous direction changes. Thus, as with other embodiments disclosed herein, flow may be controlled by more than one mechanism at the same time. Because the device progressively limits flow through the ICD module as the regulator 1431 is moved from the neutral position, the device of FIG. 14 may be referred to as a dynamic regressive device.

In the embodiment shown in FIG. 15, an adjustable regulator 1531 may be slidably mounted in a body 1511 to define a flow path 1505 between inlet 1515 and outlet 1516. A biasing member 1519, such as a spring, may hold regulator 1531 in a neutral position. In contrast to the embodiment of FIG. 14, the biasing member 1519 of FIG. 15 is located near outlet 1516. Biasing member 1519 may be attached to regulator 1531 and may be held in a recess 1561 of body 1511 by a retainer 1563. The retainer 1563 may be made of one or more pieces and have a curved shape to allow biasing member 1519 to flex within recess 1561. The shape of recess 1561 and retainer 1563 can be configured to produce a desired response from regulator 1531. For example, in the embodiment shown in FIG. 15, biasing member 1519 and retainer 1563 may shift in recess biasing member 1519 may flex toward retainer 1563 due to the curve in the retainer 1563 but is restrained from moving away from retainer 1563 because biasing member 1519 is constrained by the sidewall 1565 of recess 1561.

Body 1511 has a series of projections 1521 with "U" shaped valleys in between. Likewise, regulator 1531 has a series of teeth 1517 with "U" shaped valleys in between. Between each projection is a baffle 1518. The teeth 1517 are aligned with the baffles 1518 which are substantially centered between the projections 1521. Thus, as shown, the flow path 1505 defined between the regulator 1531 and the body 1511 is a tortuous flow path. If regulator 1531 is moved with respect to body 1511, the teeth 1517 will move toward one projection 1521 and away from baffles 1518, thus creating either a fluidic, tortuous or a choke flow configuration. Because the device progressively limit flow through the ICD module as the regulator 1531 is moved from the neutral position, the device of FIG. 15 may be referred to as a dynamic progressive device.

In adjustable ICDs such as those shown in FIGS. 13-15, the flow path geometry may be altered autonomously in response to changing downhole conditions such that the pressure drop between the inlet and outlet is changed. In one embodiment, a spring is employed for autonomous adjustment. The spring may be mechanical or magnetic. The spring tension may be fixed or adjustable by any single or combination of manual operation, electrical, intervention, and magnetic. In other embodiments, a locking mechanism may be provided to lock the regulator in a desired position.

In some embodiments, the outlet of an ICD may be partially obstructed by the regulator to achieve a desired effect. In the case of a dynamic ICD, movement of the regulator may increase or reduce the obstruction of the ICD outlet. The regulator may also be configured to obstruct the outlet more or less based on the position of the regulator, for example by tapering a portion of the regulator which may partially cover the outlet.

Figure 16:
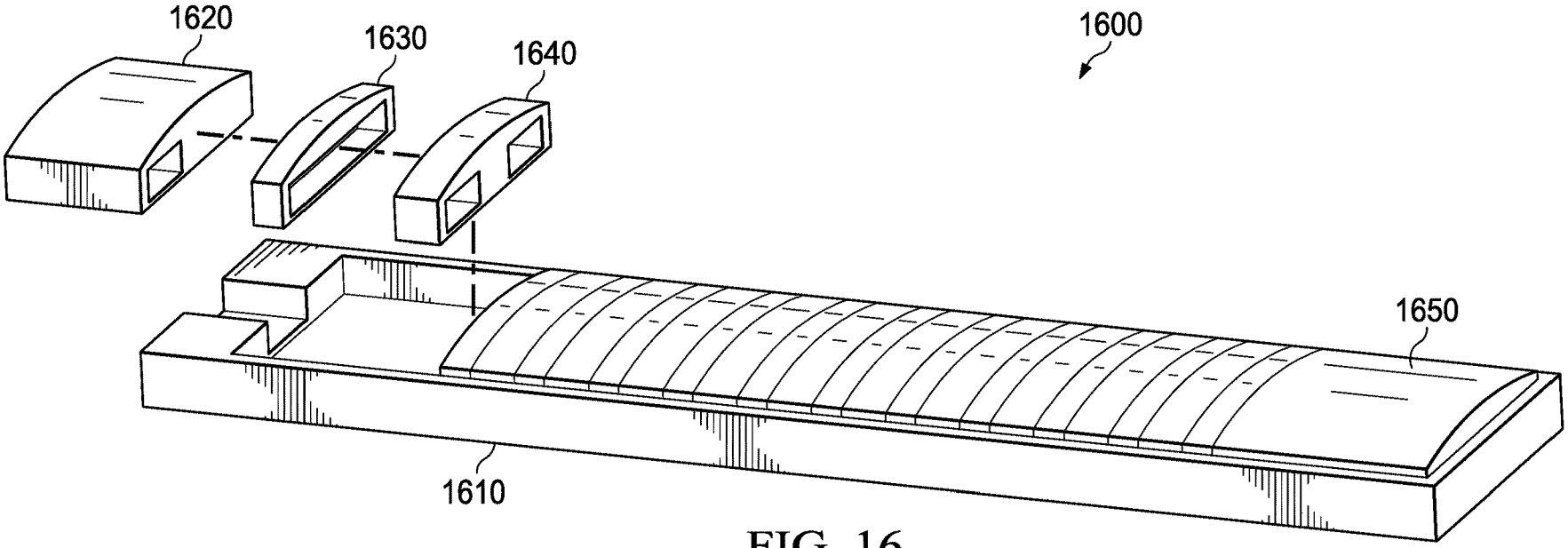
FIG. 16 depicts a diagrammatic representation of a segmented ICD module according to one embodiment.

In one embodiment, as illustrated in FIG. 16, an ICD 1600 may be comprised of an assembly of segments. The segments may be configured to fit together, for example having correspondingly shaped interface surfaces and cross sectional perimeter side to side and top to bottom shape. In the illustrated embodiment, ICD 1600 includes body 1610 and a set of segments. Body 1610 includes one or more pieces formed as tray with an indentation or cavity to accept and tightly surround the lower end of the segments. Each segment may have a portion of a flow path defined therethrough from its front interface surface to its rear interface surface. The wall defining the portion of the flow path may be configured to define a specified portion of the flow path such as an inlet segment 1620 defining an inlet to the flow path, a spacer segment 1630 defining a fully open portion of the flow path, a choke segment 1640 defining a choked region of a flow path, an outlet segment 1650 defining an outlet of the flow path, etc. These segments may be selected and installed in a tray to create many optional arrangements for the flow path extending from at least one inlet to at least one outlet. The assembly may then be installed onto a tubular, for example, in a pocket thereof.

Each segment, including inlet segment 1620, spacer segment 1630, choke segment 1640, and outlet segment 1650 may have features that, independently or in combination, may control flow through the ICD. One advantage of a segmented ICD is that the ICD can be readily switched in its entirety or segments thereof, as needed. Additionally, an ICD having the desired flow characteristics can be field-built immediately prior to installation from a selection of standard segment pieces.

Segmented ICDs may use a variety of methods for restricting flow. For example, a segmented ICD may use choke segments with larger or smaller openings. Additionally, more spacer segments (and thus less choke segments) may be used. Even if the same segments are used, the restriction through the ICD may be changed by simply rearranging the spacer segments and choke segments. For example, the segments in FIG. 16 could be switched around such that two spacer segments are adjacent to each other and two choke segments are adjacent to each other. Thus, the restriction level of the ICD may be changed from one level to another level even if no additional segments are available at the job site.

Figure 17:
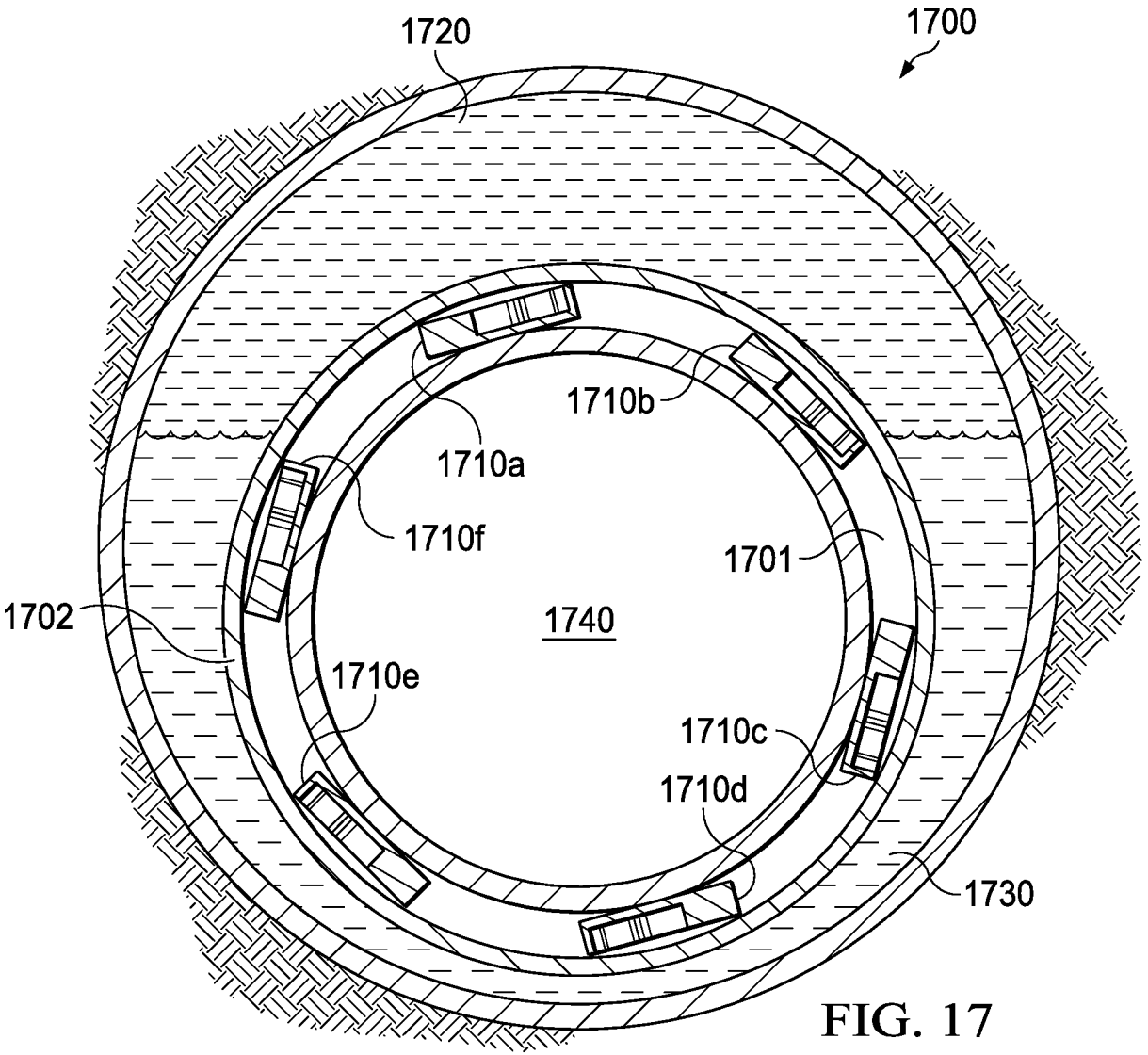
FIG. 17 depicts a sectional view of an apparatus having multiple ICD modules in accordance with one embodiment.

FIG. 17 shows an apparatus 1700 having multiple ICDs 1710 according to one embodiment. In one embodiment, apparatus 1700 comprises a tubular body 1701 having one or more ports passing therethrough that act as tubular inlets. Apparatus 1700 may further comprise a screen 1702 to screen fluid passing through the ports. Apparatus 1700 further includes multiple pockets to retain ICDs 1710 (individually ICDs 1710*a*-1710*f*) that control flow entering the tubular inlets. ICDs 1710 may include various embodiments of ICDs such as those described above.

In operation, apparatus 1700 may be surrounded by one or more fluids (e.g., oil 1720 and water 1730) which may pass through one or more ICDs 1710 to inner diameter 1740 of apparatus 1700. It may be desirable to allow one fluid, such as oil 1720 to flow into inner diameter 1740 yet restrict another fluid, such as water 1730 from flowing into inner diameter 1740. For example, ICDs 1710*a* and 1710*b* (which are surrounded by oil 1720) may flow a greater volume of oil 1720 than the volume of water allowed to flow through ICDs 1710*c*-1710*f* (which are surrounded by water 1730), despite ICDs 1710*a*-1710*f* being identical. Thus, even if the apparatus 1700 is surrounded by one or more desirable fluids and one or more undesirable fluids, multiple ICDs may improve the flow of the desirable fluid by restricting the flow of the undesirable fluid.

Figure 18A:
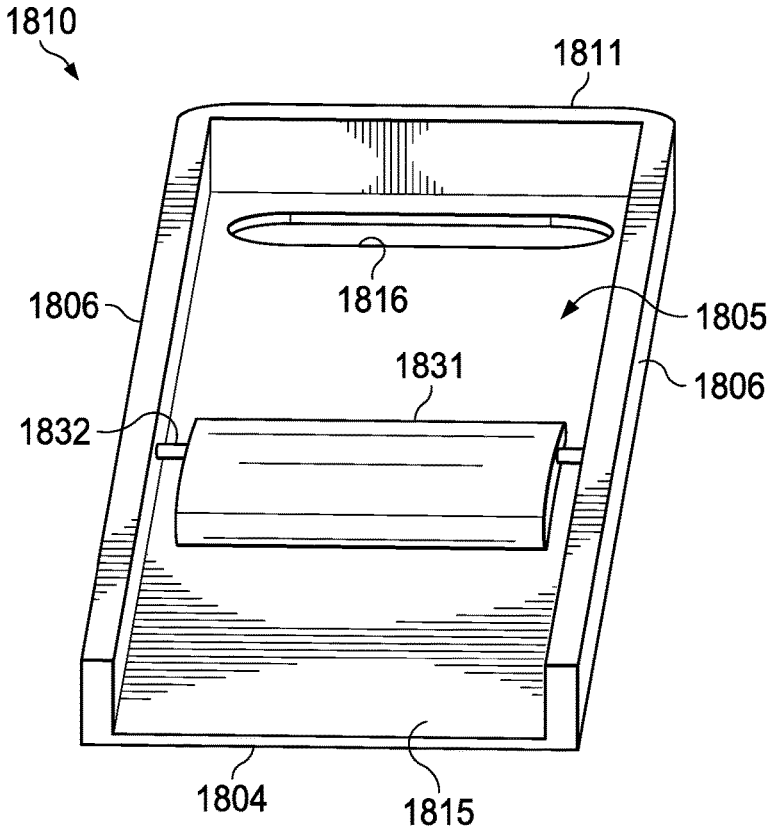
FIGS. 18A-18B are diagrammatic representations of another embodiment of an ICD module.
Figure 18B:
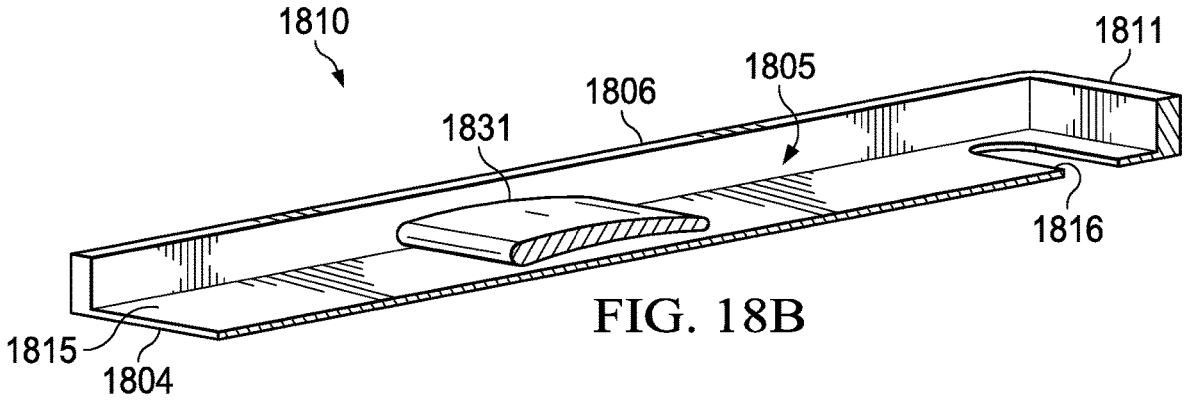

FIGS. 18A-18B illustrate another embodiment of an ICD module 1810 that can be installed in an ICD container. The illustrated ICD can have the body formed integral with an apparatus such as a tubing string tubular or the body can be installed on the wall of an apparatus (not shown), with or without a pocket. In one embodiment, ICD module 1810 comprises body 1811, a regulator 1831 and a biasing member. ICD body 1811 may include one or more pieces formed as a plate having a bottom wall 1804, which may be curved to match the curve of the outer circumference of a tubular, and sidewalls 1806 that define a flow path 1805 on the outer side of ICD body 1811. The flow path may extend from an ICD inlet 1815 to an ICD outlet 1816. ICD body 1811 is adapted such that, when installed, the ICD inlet 1815 will be open to outer surface of the tubular (open to the fluid surrounding the wellbore apparatus in which ICD module 1810 is installed) and ICD outlet 1816 will be fluidly connected (e.g., aligned or otherwise fluidly connected) to a tubular inlet port (e.g., tubular inlet port 1824 of FIG. 2B).

The ICD includes walls that define a flow path. The walls of the flow path are rectangularly configured, with opposing, substantially parallel side walls 1806 and a bottom wall 1804 opposite a top wall. The top wall is not shown but will be present by a cover either by way of a top plate installed on the body 1811 or by way of an outer wall of a pocket in which the body 1811 is installed. While the walls are rectangularly configured, they may have other geometries.

The ICD 1810 of FIGS. 18A-18B has a flow regulator 1831 installed in flow path 1805. The flow regulator 1831 is installed with a moveable connection 1832. As such, it remains secured within the flow path 1805 but can move, for example, hydrodynamically by fluid pressure acting it. More particularly, flow regulator 1831 has a configuration such as surface curvature and/or material selection that creates a hydrodynamic effect as fluid moves therepast. The hydrodynamic effect alters the drag and thereby the pressure profile of fluid that flows therepast to exploit and amplify the forces and other characteristics of the fluid flowing through the ICD module 1810. For example, one or more surfaces of the regulator may have surface texturing, profiling, material selection, hydrophilic properties or hydrophobic properties to create a desired frictional response (i.e. drag) between the regulator 1831 and fluid passing thereby.

In accordance with one embodiment, flow regulator 1831 may comprise a shape configured to create a hydrodynamic force normal to the surface as fluid flows past flow regulator 1831 in the flow path 1805. In particular, the regulator 1831 may include a surface curvature defining an airfoil shape exposed in the flow path 1805 adapted to create a high pressure region and a low pressure region around the regulator 1831. The airfoil shape can be configured so that regulator 1831 responds to fluid flow characteristics to generate hydrodynamic movement to alter flow path 1805. The shape may be selected to create a desired response.

In the illustrated embodiment, ICD module 1810 may include a biasing member, such as a spring, magnets (including electro-magnets) or other biasing member, which biases the flow regulator 1831 into a neutral position. Fluid passing through the inlet 1815 and along the flow path 1805 results in a pressure differential. The biasing member normally maintains the flow regulator 1831 in a neutral position but if the pressure at inlet 1815 increases, the biasing member allows the flow regulator 1831 to shift within the body 1811. Increased pressure may cause the flow regulator 1831 to move into a choke flow position to reduce the flow through the ICD 1810. The moveable connection 1832 in this embodiment is a pivotal connection, allowing rotational movement about the movable connection 1832.

Flow regulator 1831 thus rotates about connection 1832 to change the distance between the flow regulator and the upper and lower walls of body 1811. As will be appreciated, the regulator 1831 may pivot against the bias in the biasing member 1833 about the pivotal connection 1832 towards a low pressure region generated by fluid flowing over the airfoil shape. In one embodiment, regulator 1831 moves from a neutral position with the leading end of the airfoil shape positioned alongside bottom wall 1806 to a position where the leading end 1842 of the airfoil shape extends across the flow path 1805. This embodiment produces a force and load amplification by utilizing hydrodynamic effects that may cause regulator 1831 to move based on changes in density, viscosity, turbulence, etc.

As discussed above, a wing-type ICD causes increased sensitivity to changes in fluid density, providing sensitivity to water production. When crude is flowing a certain hydrodynamic force is exerted on regulator 1831. When water production starts, the water has a higher density than the crude and will increase the force/load on the wing, causing it to move to reduce the total flow rate.

As will be appreciated, this ability of the ICD to act as a valve to transition from an open, substantially unchoked condition to a choked, substantially closed condition may permit automatic response to downhole conditions such as a gas or water break through. The ability to change in situ between choked and unchoked flows, is also useful when converting from producer (flow into the apparatus) to injector (flow out of the apparatus) or between oil and gas.

The flow regulator 1831 may be configured to be hydrophilic, to have improved water wetting features, or have other properties. For example, the flow regulator 1831 may have all or a portion of its surface adapted or formed of a hydrophilic material. By making the surface of the regulator 1831 hydrophilic, water will generate a higher friction (i.e. drag) across the regulator 1831 than other fluids such as oil or gas. As such, the regulator 1831 may move more when water flows through the flow path 1805 than when non-aqueous fluids flow through the flow path 1805. Water flows may, therefore, tend to force the regulator 1831 readily into a choking position to selectively stop water production.

The regulator 1831 may be shaped to have a width substantially the same as the flow path 605 to substantially block flow from passing to the sides of regulator 1831. However, as shown, the width of the regulator 1831 may be slightly less than the flow path 1805 such that there may be some clearance to ensure that there is always some flow therepast even if the regulator 1831 is pivoted or breaks off and becomes positioned entirely across the flow path.

Some embodiments of ICDs described herein can include a flow path that has walls configured such that the flow path is rectangular in cross sectional shape, though the cross-section of the flow path may be circular, oblong, or any other shape. In one embodiment, the ICD walls are fixed, while in another embodiment, the ICD includes a flow path altering mechanism (e.g., a regulator) such that ICD walls are adjustable. In some embodiments, the flow path altering mechanism may be set at surface to select a flow path and remain fixed during operation. In other embodiments, the flow path altering mechanism may be adjusted through intervention such as by signaling or by physical contact with an actuating tool moved from surface and communicating with the flow path altering mechanism via an inner diameter of the apparatus in which it is installed. The flow path altering mechanism may also alter flow path geometry in response to changing downhole conditions, for example as a result of changes in fluid flow characteristics such as fluid density, viscosity, phase composition, flow rate, etc., such that the pressure drop between the inlet and outlet is changed. Movement of a flow path altering mechanism (including the adjustable regulators as shown in FIGS. 3-4, 6, 7, 9, and 13-15, 18) may be controlled by one or more of: springs, magnets, mechanical, hydraulic, pneumatic, solenoids, etc. In some embodiments, a flow path adjustment mechanism may be controlled remotely (e.g., by an operator on the surface).

The flow path altering mechanism may change the flow path characteristics such that the pressure regulation principles change from approximately non-sensitive to changes in fluid rheology to sensitive to changes in fluid rheology. The flow path characteristics can be changed one or more times.

The flow path altering mechanism may comprise one or more walls of a flow path that are movable relative another flow path wall. The flow path altering mechanism may be moveable based on hydrodynamic forces generated by fluid passing thereby. A wall may be moved toward an opposite wall to reduce the flow path area and/or to change the flow pattern between the walls or a wall may be moved away from an opposite wall to increase the flow path area and/or change the flow pattern. Adjustment of the walls may alter the flow path between multiple configurations including, but not limited to, a choke flow configuration, a tortuous flow configuration or fluidic flow configuration. In one embodiment, adjustment of a wall may generate a plurality of chokes along the flow path. The formation of the walls to define chokes and/or tortuous flow paths in series may provide a more gradual pressure drop, which may reduce scaling and erosion.

The flow path altering mechanism may also comprise an airfoil that has a surface curvature such as a camber that generates hydrodynamic forces relative the fluid moving through the path to move the flow path altering mechanism within the flow path.

The flow path altering mechanism may be installed in an ICD but be moveable in its installation position. The flow path altering mechanism may be moveable for example, axially, laterally, rotationally, or radially relative to a fixed wall. The flow path altering mechanism may be installed by a moveable connection, such as a pivotal connection or an axially slidable connection. The surface on the mechanism, which may define one wall of the flow path, may be straight, curved, smooth, textured, etc. as desired to define a particular selected flow path configuration.

According to one aspect, ICD embodiments ICD embodiments disclosed herein can permit field selection of style and type of ICD and adjustment (for example, by accessing the flow path altering mechanism and adjusting its position to select a flow path geometry). In addition, because some embodiments are installable in a removable configuration, it is possible to replace and repair ICDs, and to upgrade ICDs if new technology becomes available.

An ICD may be formed integral in an apparatus. In another embodiment, however, the ICD may be installed in a pocket on an apparatus. The pocket may be constructed in a wall of the apparatus and the pocket may include an inlet port from the outer surface of the apparatus to the interior of the pocket and an outlet port from interior of the pocket to the inner diameter of the apparatus. If the apparatus comprises a screen, the pocket may be installed upstream or downstream of the screen to either accept screened flows at the inlet or flow from the outlet to the screen.

An ICD may include a body that fits into the pocket. The body can include a flow path inlet, a flow path outlet and fixed walls. The body may be configured such that when in the pocket, the flow path inlet end aligns with or is otherwise in fluid communication with the pocket inlet port and the flow path outlet aligns with or is otherwise in fluid communication with the pocket outlet port. The body can take many forms and include further flow path walls that are fixed or may include a flow regulating mechanism to define one of the flow path walls, or the body can accommodate dynamic controllers, etc. Such a flow control device may be modular.

While the flow paths may be entirely defined by the body, in some embodiments, the pocket walls may define some portion of the flow path. In other words, the flow path on the body may be open along its length to some degree with the inner walls of the pocket forming some of the walls about the flow path.

The pocket interior may be substantially linear and the body may be shaped as an elongate plate. As such, the body may be easily slidable into the pocket through an end thereof. Alternately, the pocket may be open along a greater length and the body may be installable in the pocket and thereafter a cover may be installed to complete the pocket. In any event, the body may be secured in the pocket for use.

In some embodiments, the body may have an outside geometry that is predominantly rectangular. The body may be adapted to fit in a pocket of a tubular, either completely or with a portion of the body extending out of the pocket. The body may have a curvature similar to the curvature of the apparatus on or within which the flow control device it is mounted.

Embodiments described herein may also provide a highly optimized ID to OD ratio, causing the devices in which the ICD is installed to be better optimized which in turn may allow for higher flow rates.

Embodiments described herein further provide ICDs that may have non-helical flow paths.

Embodiments described herein can provide further flexibility to allow a producing well to be converted from a predominantly oil producing well to be reconfigured for a predominantly gas producing or injection well or even a water injection well.

While the embodiments illustrated show the body extending in an axial direction with a predominately axial flow path along the apparatus and axial movement of the flow regulator relative to the body, it is to be appreciated that the same effect could be obtained by having the body curved and extending in other orientations, such as circumferentially to some degree around apparatus, and any moveable flow regulator moving radially, circumferentially, rotationally relative to the fixed wall.

Embodiments of ICD described herein can offer a unitized design wherein a pressure drop is contained in a single unit. The body and, if present, the flow regulator may be made from durable materials such as ceramic, tungsten carbide, etc. that are selected for their resistance to corrosion and/or erosion.

While the ICDs disclosed herein have been shown in many configurations (e.g., fixed flow path, adjustable flow path, segmented design, etc.), many other configurations are contemplated. For example, any combination of features disclosed herein may be used in an ICD design. One embodiment of an ICD may contain a fixed flow path portion and an adjustable flow path portion. Another embodiment may contain a fixed flow path portion and a segmented design. Still another embodiment may have selectable positions in addition to an automatically adjusting portion.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

We claim:

1. A reconfigurable inflow control (ICD) module adapted to be received in a pocket of a tubular having a tubular wall, the pocket partially defined by a tubular inlet port extending through the tubular wall to an inner bore of the tubular, and the pocket having a shape, comprising:

a body having a form factor that is compatible with the shape of the pocket, the body including an inlet opening, an outlet opening fluidly connected to the tubular inlet port, and inner side walls forming a shaped channel between the inlet opening and the outlet opening; and a regulator with one or more walls that each have a plurality of projections with curved valleys in between the projections, the regulator adapted to be disposed in a particular position of a plurality of possible positions inside the shaped channel, to configure a flow path between the inlet opening and outlet opening with a specific flow characteristic for fluid flowing across the flow path.

2. The reconfigurable ICD module of claim 1, wherein the specific flow characteristic is a pressure drop across the flow path or a flow rate.

3. The reconfigurable ICD module of claim 2, wherein an increase in pressure at the inlet opening causes the regulator to move axially in order to reduce the flow through the module.

4. The reconfigurable ICD module of claim 1, wherein the regulator is movably attached to the body by a biasing member to provide an autonomous ICD.

5. The reconfigurable ICD module of claim 4, wherein the biasing member is a spring.

6. The reconfigurable ICD module of claim 4, wherein the biasing member maintains the regulator in a neutral position in the shaped channel and allows the regulator to shift axially when a flow characteristic for fluid flowing across the flow path changes.

7. The reconfigurable ICD module of claim 1, wherein the flow path assumes one of a tortuous path configuration, a fluidics path configuration and a choke configuration.

8. The reconfigurable ICD module of claim 1, wherein the regulator is axially movable inside the shaped channel.

9. The reconfigurable ICD module of claim 1, wherein the flow path comprises one or more choke points.

10. The reconfigurable ICD module of claim 1, wherein a width of the flow path defined by the inner side walls and the regulator is adjustable by changing the position of the regulator inside the shaped channel.

11. The reconfigurable ICD module of claim 1, wherein the inner side walls and the regulator are adapted to provide more than one flow paths.

12. The reconfigurable ICD module of claim 1, further comprising a locking member for locking the regulator in the particular position to provide a fixed-adjustable ICD.

13. A modular inflow control device (ICD) adapted to be installed into, and extracted from a pocket provided in a wellbore tubular, comprising:

an ICD container with a tubular wall and a container inlet opening extending through the tubular wall, the ICD container being provided with threads at both ends for enabling connection with additional ICD containers;

a pocket in the tubular wall having a pocket inlet port in communication with the container inlet opening; and an ICD module according to claim 1, removably disposable in the pocket, having a compatible form factor with the pocket, the ICD module configurable to provide a pressure drop regulating flow path between an inlet port exposed to a fluid surrounding the ICD container and the container inlet opening, the flow path being adjustable based on a specified flow characteristic.

14. The modular ICD of claim 13, further comprising additional ICD containers, wherein each additional ICD container houses an ICD module for adjusting a different flow characteristic, to balance flow rate across a zone.

15. The modular ICD of claim 13, wherein the ICD container houses two or more ICD modules, each ICD module for adjusting a different flow characteristic, to balance a flow rate across the ICD container.

16. The modular ICD of claim 13, further comprising a pocket cover to provide an upper wall to the flow path.

17. A reconfigurable inflow control (ICD) module, comprising:

a rectangular body adapted to be received in a pocket of a wellbore tubular, the body having a compatible form factor with the pocket, the body including:

an inlet opening, exposed to a fluid surrounding the wellbore tubular, an outlet opening into the pocket; and inner side walls, forming a channel therebetween; and a regulator pivotally attached to the body by a biasing member, the regulator adapted to autonomously assume a particular position of a plurality of possible positions inside the channel, conditional on one or more flow characteristics of the fluid flowing across a flow path established between the inlet opening and outlet opening.

18. The reconfigurable ICD module of claim 17, wherein the regulator has an airfoil shape, separating the channel in a region of low pressure and a region of high pressure.

19. The reconfigurable ICD module of claim 18, wherein the regulator is displaced between the low pressure regions and high-pressure regions dependent on changes in one or more of fluid density, viscosity, turbulence pressure and rate.

* * * * *